US012560396B2

(12) United States Patent
Helmikkala et al.

(10) Patent No.: US 12,560,396 B2
(45) Date of Patent: Feb. 24, 2026

(54) ASSEMBLY FOR A FIREARM

(71) Applicant: Jägear Oy, Espoo (FI)

(72) Inventors: Ilkka Helmikkala, Espoo (FI); Saku Everi, Espoo (FI); Wycliffe Raduma, Espoo (FI)

(73) Assignee: JAGEAR OY, Espoo (FI)

( * ) Notice: Subject to any disclaimer, the term of this patent is extended or adjusted under 35 U.S.C. 154(b) by 0 days.

(21) Appl. No.: 18/890,085

(22) Filed: Sep. 19, 2024

(65) Prior Publication Data

US 2025/0093121 A1 Mar. 20, 2025

(30) Foreign Application Priority Data

Sep. 20, 2023 (FI) ..... 20236038

(51) Int. Cl.
*F41A 21/30* (2006.01)

(52) U.S. Cl.
CPC ..... *F41A 21/30* (2013.01)

(58) Field of Classification Search
CPC ..... F41A 21/325; F41A 21/34
See application file for complete search history.

(56) References Cited

U.S. PATENT DOCUMENTS 4,893,426 A * 1/1990 Bixler ..... F16B 7/20 89/14.05
7,905,170 B1 * 3/2011 Brittingham ..... F41A 21/34 89/14.4
8,490,535 B1 * 7/2013 Moore ..... F41A 21/34 42/1.06
9,121,656 B1 * 9/2015 McKenzie ..... F41A 21/30
9,921,021 B1 * 3/2018 Graham, II ..... F41A 21/325
10,480,888 B2 * 11/2019 Barrett ..... F41A 21/28
10,619,962 B1 * 4/2020 Hatfield ..... F41A 21/44
(Continued)

FOREIGN PATENT DOCUMENTS

EP 2805125 12/2016
EP 3514475 A1 7/2019
(Continued)

OTHER PUBLICATIONS

Search Report for FI20236038, dated Apr. 10, 2024, 2 pages.
European Search Report cited in EP 24201235.9 mailed Jan. 28, 2025, 11 pages.

*Primary Examiner* — Derrick R Morgan
(74) *Attorney, Agent, or Firm* — Nixon & Vanderhye P.C.

(57) ABSTRACT

An assembly (1) for a firearm (2). The assembly includes a muzzle device (3) configured to be attached to the firearm (2), a substantially tubular muzzle adapter (9), a substantially tubular attachment mount (15), a substantially tubular clutch collar (19), and a device (23) such as a sound suppressor. The device (23) is releasably attached to the substantially tubular attachment mount (15) by an attachment device (25). The muzzle device (3) is configured to be releasably received in the substantially tubular muzzle adapter (9). The substantially tubular muzzle adapter (9) is attached to the substantially tubular clutch collar (19) for rotation about the longitudinal central axis A together with the substantially tubular clutch collar (19) with respect to the device (23), to the muzzle device (3) and to the substantially tubular attachment mount (15) between (i) a locking position, and (ii) an unlocking position.

19 Claims, 17 Drawing Sheets

(56) References Cited

U.S. PATENT DOCUMENTS

| | | | | |
|---|---|---|---|---|
| 10,801,796 | B2 * | 10/2020 | Kras | F41A 21/325 |
| 10,883,787 | B2 * | 1/2021 | Palu | F41A 21/30 |
| 11,287,207 | B2 * | 3/2022 | DeJessa | F41A 21/30 |
| 11,486,670 | B1 * | 11/2022 | Lovas | F41A 21/325 |
| 12,163,750 | B2 * | 12/2024 | Griffitts | F41A 21/30 |
| 12,313,361 | B2 * | 5/2025 | DeJessa | F41A 21/325 |
| 2006/0060076 | A1 * | 3/2006 | Dueck | F41A 21/325 89/14.4 |
| 2010/0313743 | A1 | 12/2010 | Dueck et al. | |
| 2011/0197487 | A1 * | 8/2011 | Humston | F41A 21/34 42/1.06 |
| 2012/0272818 | A1 * | 11/2012 | Dueck | F41A 21/30 29/896.2 |
| 2016/0102935 | A1 | 4/2016 | Young | |
| 2017/0097205 | A1 * | 4/2017 | Palu | F41A 21/325 |
| 2020/0056855 | A1 * | 2/2020 | Palu | F41A 21/325 |
| 2021/0199401 | A1 * | 7/2021 | Magee | F41A 21/30 |
| 2021/0348869 | A1 * | 11/2021 | Kmetz | F41A 21/325 |
| 2021/0389074 | A1 * | 12/2021 | Reis-Green | F41A 21/325 |
| 2023/0128649 | A1 * | 4/2023 | Lee | F41A 21/325 89/14.05 |
| 2023/0138685 | A1 * | 5/2023 | Wilson | F41A 21/325 89/14.05 |
| 2023/0228516 | A1 * | 7/2023 | Reis Green | F41A 21/325 89/14.05 |
| 2023/0296344 | A1 * | 9/2023 | Graham, II | F41A 21/325 89/14.4 |
| 2024/0060742 | A1 * | 2/2024 | DeJessa | F41A 21/325 |
| 2024/0142191 | A1 * | 5/2024 | Fredrickson | F41A 21/325 |
| 2025/0305786 | A1 * | 10/2025 | Olsen | F41A 21/325 |

FOREIGN PATENT DOCUMENTS

| | | |
|---|---|---|
| WO | 2019102510 | 5/2019 |
| WO | 2019102510 A1 | 5/2019 |

* cited by examiner

ASSEMBLY FOR A FIREARM

RELATED APPLICATION

This application incorporates by reference and claims priority to Finnish patent application 20236038, filed Sep. 20, 2023.

FIELD OF THE INVENTION

The invention relates to an assembly for a firearm and particularly for an assembly for a muzzle of a barrel of a firearm, which assembly can quickly and reliably be fastened to the muzzle of the barrel of the firearm.

SUMMARY OF DISCLOSURE

An assembly (1) for a firearm (2) has been conceived and disclosed herein that includes a muzzle device (3) configured to be attached to a barrel (4) of the firearm (2), wherein the muzzle device (3) having a first proximal end (5), and a first distal end (6), and wherein the muzzle device (3) being provided with a number of successive locking teeth (7) and first channels (8) around an outer circumference of the muzzle device (3), a substantially tubular muzzle adapter (9) having a first tubular body (10), a second proximal end (11), and a second distal end (12), wherein the substantially tubular muzzle adapter (9) being provided with a number of successive locking lugs (13) and second channels (14) around an inner circumference of the substantially tubular muzzle adapter (9), a substantially tubular attachment mount (15) having a second tubular body (16), a third proximal end (17), and a third distal end (18), a substantially tubular clutch collar (19) having a third tubular body (20), a fourth proximal end (21), and a fourth distal end (22), and a device (23) such as a sound suppressor having a fifth proximal end (24), wherein the device (23) being releasably attached to the substantially tubular attachment mount (15) by means of attachment device (25), wherein the muzzle device (3) being configured to be releasably received in the substantially tubular muzzle adapter (9) so that co-operating rotation prevention devices (26) of the muzzle device (3) and at least one of the device (23) and the substantially tubular attachment mount (15) prevents the muzzle device (3) from rotating with respect to the device (23) and/or to the substantially tubular muzzle adapter (9) about the longitudinal central axis A, and wherein the substantially tubular muzzle adapter (9) being attached to the substantially tubular clutch collar (19) for rotation about the longitudinal central axis A together with the substantially tubular clutch collar (19) with respect to the device (23), to the muzzle device (3) and to the substantially tubular attachment mount (15) between (i) a locking position, where successive locking teeth (7) of the muzzle device (3) are in the direction of the longitudinal central axis A at least partly aligned with the locking lugs (13) of the substantially tubular muzzle adapter (9) so as to prevent relative movement between the muzzle device (3) and the substantially tubular muzzle adapter (9) in the direction of the longitudinal central axis A, and (ii) an unlocking position, where successive locking teeth (7) of the muzzle device (3) are in the direction of the longitudinal central axis A aligned with the second channels (14) of the substantially tubular muzzle adapter (9) and where successive locking lugs (13) of the substantially tubular muzzle adapter (9) are in the direction of the longitudinal central axis A aligned with the first channels (8) of the muzzle device (3) so as to allow relative movement between the muzzle device (3) and the substantially tubular muzzle adapter (9) in the direction of the longitudinal central axis A.

The muzzle device (3) may have a threaded inner surface extending from the first proximal end (5).

The substantially tubular attachment mount (15) may have a first radially inwardly projecting flange (27) at the third proximal end (17), wherein the first radially inwardly projecting flange (27) tapers in steps, arcuately and/or linearly towards the third proximal end (17), by the substantially tubular muzzle adapter (9) having a radially outwardly projecting flange (28) at the second distal end (12), wherein the radially outwardly projecting flange (28) tapers in steps, arcuately and/or linearly towards the second proximal end (11), and by the radially outwardly projecting flange (28) of the substantially tubular muzzle adapter (9) circumferentially abuts the first radially inwardly projecting flange (27) of the substantially tubular attachment mount (15).

The substantially tubular clutch collar (19) may have first throughgoing locking holes (30) in the third tubular body (20) at the fourth proximal end (21), by the substantially tubular muzzle adapter (9) having second throughgoing locking holes (31) in the first tubular body (10) at the second proximal end (11), and by at least one first throughgoing locking hole (30) of the substantially tubular muzzle adapter (9) and at least one second throughgoing locking hole (31) in the substantially tubular clutch collar (19) being aligned and a fastener (32) being provided in said at least one first throughgoing locking hole (30) of the substantially tubular muzzle adapter (9) and said at least one second throughgoing locking hole (31) in the substantially tubular clutch collar (19) to fasten the substantially tubular muzzle adapter (9) to the substantially tubular clutch collar (19).

The second proximal end (11) of the substantially tubular muzzle adapter (9) and the fourth proximal end (21) of the substantially tubular clutch collar (19) may include cooperating locking projections and grooves (33) for preventing the substantially tubular clutch collar (19) from rotating with respect to the substantially tubular muzzle adapter (9) about the longitudinal central axis A.

The fifth proximal end (24) of the device (23) may be releasably received in the third distal end (18) of the substantially tubular attachment mount (15).

The attachment device (25) may include bayonet grooves (34) at one of the second tubular body (16) of the substantially tubular attachment mount (15) and the device (23) and projections (35) for cooperation with the bayonet grooves (34) at the other of the second tubular body (16) of the substantially tubular attachment mount (15) and the device (23), providing an openable and closable locking means (36) for locking the device (23) in position with respect to the substantially tubular attachment mount (15), when the projections (35) are received in the bayonet grooves (34).

The attachment device (25) may include an inner threading (58) or an outer threading on the second tubular body (16) of the substantially tubular attachment mount (15) and an outer threading (59) or an inner threading on the device (23) for co-operation with the inner threading (58) or the outer threading on the second tubular body (16) of the substantially tubular attachment mount (15), providing an openable and closable lock (36) for locking the device (23) in position with respect to the substantially tubular attachment mount (15), when the device (23) is releasable attached to the substantially tubular attachment mount (15) by means of the outer threading (59) and the inner threading (58) of the attachment means (25).

An arc-shaped groove (37) in an end surface (38) at the third proximal end (17) of the substantially tubular attachment mount (15), wherein the arc-shaped groove (37) has a locking recess (39), by a spring arm (40) with a locking nose (41) and a button (42) being pivotally connected to third inner surface (43) of the substantially tubular clutch collar (19) so that the button (42) of the spring arm (40) extends through an opening (44) in the third tubular body (20) of the substantially tubular clutch collar (19), and by a first spring (45) being provided and configured to press the button (42) of the spring arm (40) through the opening (44) in the third tubular body (20) of the substantially tubular clutch collar (19), wherein the locking nose (41) of the spring arm (40) being configured to move in the arc-shaped groove (37) in the end surface (38) of the substantially tubular attachment mount (15) when the substantially tubular muzzle adapter (9) together with the substantially tubular clutch collar (19) is rotated about the longitudinal central axis A with respect to the substantially tubular attachment mount (15), to the muzzle device (3), and to the device (23) between the locking position and the unlocking position, and wherein rotating of the substantially tubular muzzle adapter (9) together with the substantially tubular clutch collar (19) with respect to the substantially tubular attachment mount (15), to the muzzle device (3), and to the device (23) about the longitudinal central axis A is prevented by rotating the substantially tubular muzzle adapter (9) together with the substantially tubular clutch collar (19) with respect to the substantially tubular attachment mount (15) into the locking position resulting in that the locking nose (41) of the spring arm (40) enters the locking recess (39) of the arc-shaped groove (37), and wherein the locking nose (41) of the spring arm (40) can be brought out of the locking recess (39) of the arc-shaped groove (37) by pressing the button (42) of the spring arm (40).

A second spring (46) may be configured to be loaded when the substantially tubular clutch collar (19) together with the circular muzzle adapter (9) is rotated about the longitudinal central axis A with respect to the circular attachment mount (15), to the muzzle device (3), and to the device (23) in direction away from the locking position.

The substantially tubular clutch collar (19) may have a second radially inwardly projecting flange (47) at the fourth proximal end (21).

There may be profiling (48) at an outer surface of the substantially tubular clutch collar (19).

There may be successive locking teeth (7) and first channels (8) around the outer circumference of the muzzle device (3) comprises successive locking teeth of a first locking teeth type (7*a*) and first channels (8) around the outer circumference of the muzzle device (3) at a first axial location of the muzzle device (3) and successive locking teeth of a second locking teeth type (7*b*) and first channels (8) around the outer circumference of the muzzle device (3) at a second axial location of the muzzle device (3), by the locking teeth (7) of the first locking teeth type (7*a*) and the locking teeth (7) of the second locking teeth type (7*b*) are separated by a first groove (53) in the axial direction of the muzzle device (3), by the locking teeth (7) of the first locking teeth type (7*a*) have a design that differs from the design of the locking teeth (7) of the second locking teeth type (7*b*), by said number of successive locking lugs (13) and second channels (14) around the inner circumference of the substantially tubular muzzle adapter (9) comprises successive locking lugs of a first locking lugs type (13*a*) and second channels (14) around the inner circumference of substantially tubular muzzle adapter (9) at a first axial location of the substantially tubular muzzle adapter (9) and successive locking lugs of a second locking lugs type (13*b*) and second channels (14) around the inner circumference of the substantially tubular muzzle adapter (9) at a second axial location of the substantially tubular muzzle adapter (9), by the locking lugs (13) of the first locking lugs type (13*a*) and the locking lugs (13) of the second locking lugs type (13*b*) are separated by a second groove (54) in the axial direction of the substantially tubular muzzle adapter (9), by the locking lugs (13) of the first locking lugs type (13*a*) have a design that differs from the design of the locking lugs (13) of the second locking lugs type (13*b*), by the locking teeth (7) of the first locking teeth type (7*a*) have a design and the locking teeth (7) of the second locking teeth type (7*b*) have a design that prevents one of the locking teeth (7) of the first locking teeth type (7*a*) and the locking teeth (7) of the second locking teeth type (7*b*) from entering the second groove (54) but that allows the other of locking teeth (7) of the first locking teeth type (7*a*) and the locking teeth (7) of the second locking teeth type (7*b*) to enter the second groove (54) when the muzzle device (3) is rotated with respect to the substantially tubular muzzle adapter (9) about the longitudinal central axis A, and by the locking lugs (13) of the first locking lug type (13*a*) have a design and the locking lugs (13) of the second locking lug type (13*b*) have a design that prevents one of the locking lugs (13) of the first locking lug type (13*a*) and the locking lugs (13) of the second locking lug type (13*b*) from entering the first groove (53) but that allows the other of the locking lugs (13) of the first locking lug type (13*a*) and the locking lugs (13) of the second locking lug type (13*b*) to enter the first groove (53) when the muzzle device (3) is rotated with respect to the substantially tubular muzzle adapter (9) about the longitudinal central axis A.

The muzzle device (3) may extend into the device (23) when the muzzle device (3) is releasable received in the substantially tubular muzzle adapter (9).

The co-operating rotation prevention assembly (26) may be formed at least partly of tines (49) of the muzzle device (3) and by recesses (50) in the device (23) sized and shaped for complementary receipt of at least a portion of the tines (49) of the muzzle device (3).

The second distal end (12) of the substantially tubular muzzle adapter (9) may be received in or surrounded by the substantially tubular attachment mount (15), and by the second proximal end (11) of the substantially tubular muzzle adapter (9) being received in or surrounded by the substantially tubular clutch collar (19).

The third proximal end (17) of the substantially tubular attachment mount (19) may be received in or surrounded by the substantially tubular clutch collar (19).

The second tubular body (16) of the substantially tubular attachment mount (15) may have at the third proximal end (17) of the substantially tubular attachment mount (15) a shoulder (36) at the outer surface of the second tubular body (16) of the substantially tubular attachment mount (15) and an outer surrounding guiding surface (56) at the outer surface of the second tubular body (16) of the substantially tubular attachment mount (15) between the shoulder (55) and the third proximal end (17) of the substantially tubular attachment mount (15), by the fourth distal end (22) of the substantially tubular clutch collar (19) abuts the shoulder (55), and by an inner surrounding guiding surface (57) at the fourth distal end (22) of the third tubular body (20) of the substantially tubular clutch collar (19) circumferentially abuts the outer surrounding guiding surface (56) at the outer surface of the second tubular body (16) of the substantially tubular attachment mount (15).

At least one of the muzzle device (3), the substantially tubular muzzle adapter (9), the substantially tubular attachment mount (15), the substantially tubular clutch collar (19), and the device (23) may be made of metal.

SUMMARY OF DRAWINGS

In the following the invention will described in more detail by referring to the figures of which

DETAILED DESCRIPTION

Figure 1:
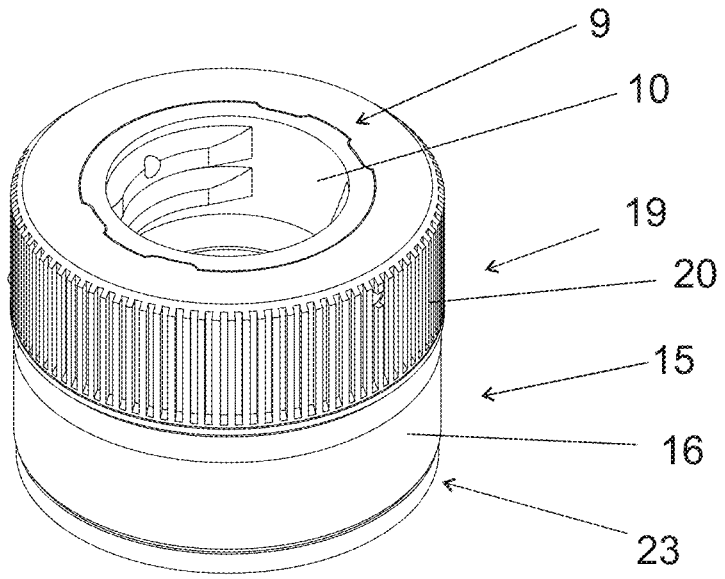
FIG. 1 shows the muzzle adapter, the attachment mount and the clutch collar of an embodiment of the assembly in an assembled state.
Figure 2:
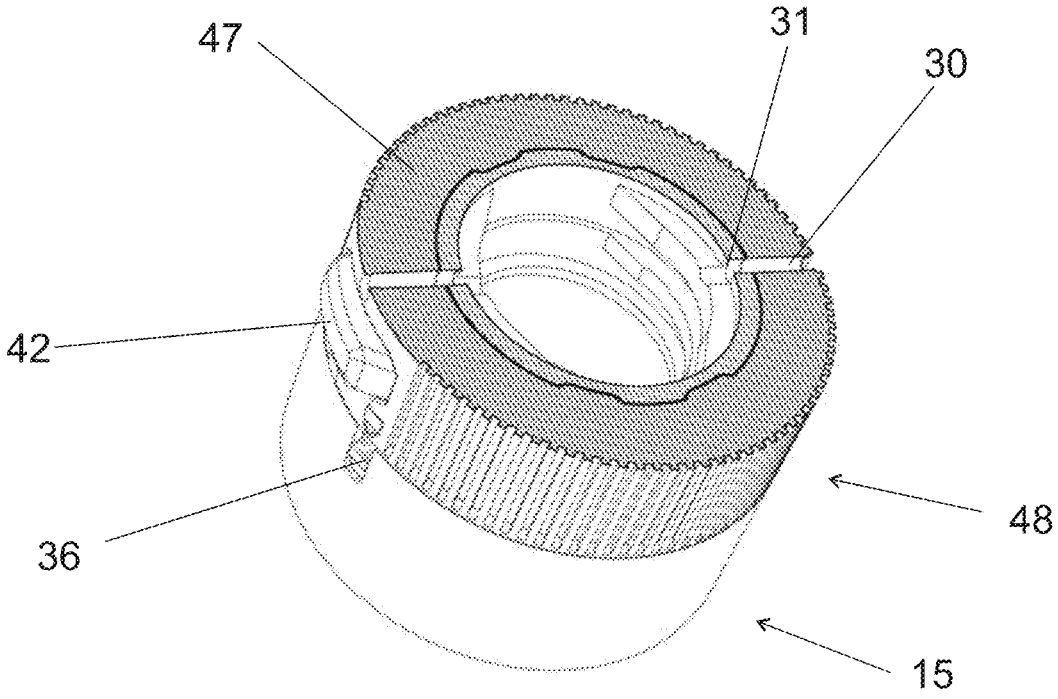
FIG. 2 shows the substantially tubular muzzle adapter, the substantially tubular attachment mount and the substantially tubular clutch collar of the assembly in the assembled state illustrated in FIG. 1 and as cut transversely to the longitudinal axis of the assembly at first throughgoing locking holes in the substantially tubular clutch collar and at second throughgoing locking holes in the substantially tubular muzzle adapter.
Figure 3:
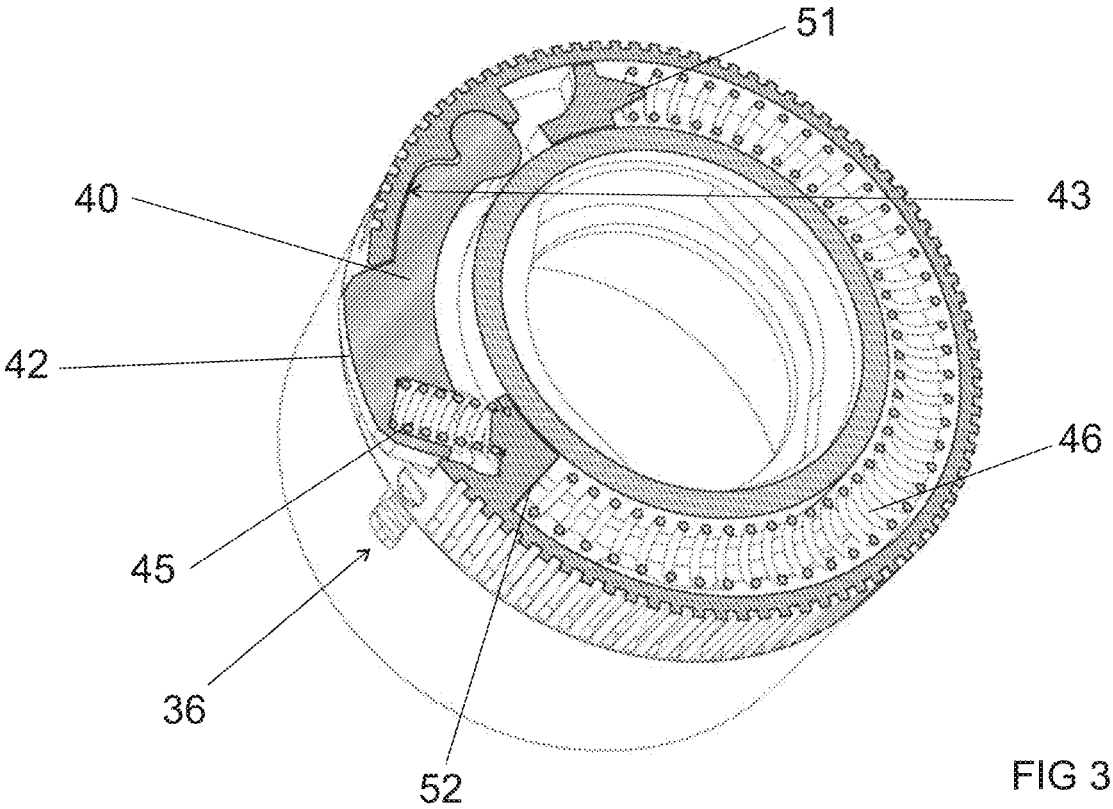
FIG. 3 shows the substantially tubular muzzle adapter, the substantially tubular attachment mount and the substantially tubular clutch collar of the assembly in the assembled state illustrated in FIG. 1 and as cut transversely to the longitudinal axis of the assembly at a spring arm provided at a third inner surface of the substantially tubular clutch collar.
Figure 4:
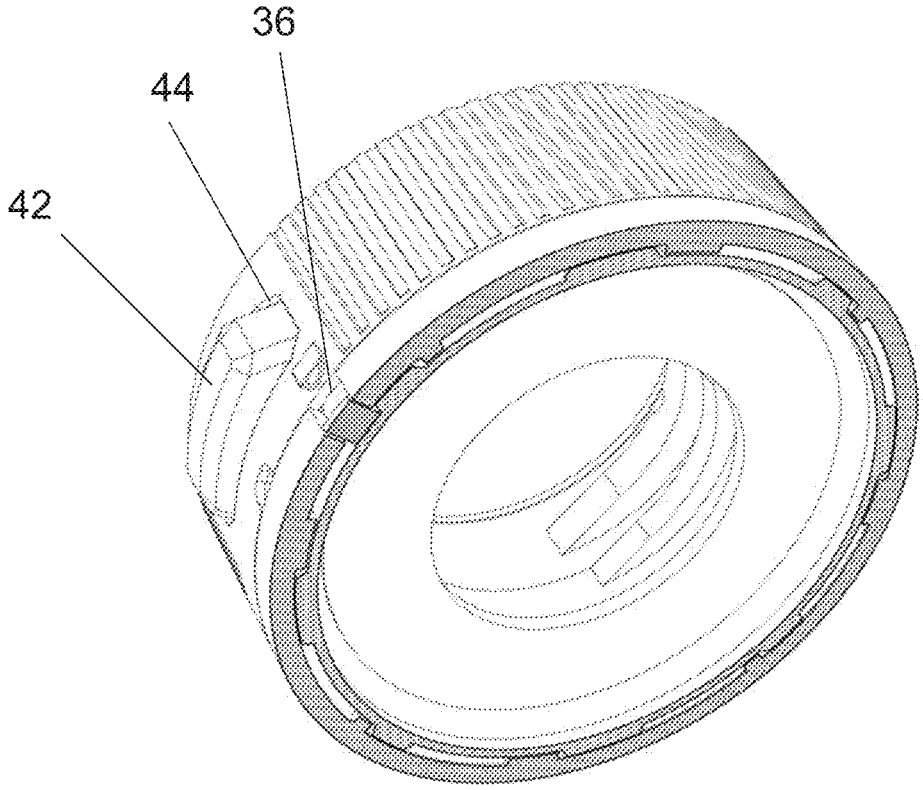
FIG. 4 shows the substantially tubular muzzle adapter, the substantially tubular attachment mount and the substantially tubular clutch collar of the assembly in the assembled state illustrated in FIG. 1 and as cut transversely to the longitudinal axis of the assembly close to the second distal end of the substantially tubular muzzle adapter, FIG. 5 the substantially tubular muzzle adapter, the substantially tubular attachment mount and the substantially tubular clutch collar of an embodiment of the assembly in an assembled state and as cut along the longitudinal axis of the assembly and in a state where the muzzle device is in an unlocking position received in the substantially tubular muzzle adapter.
Figure 5:
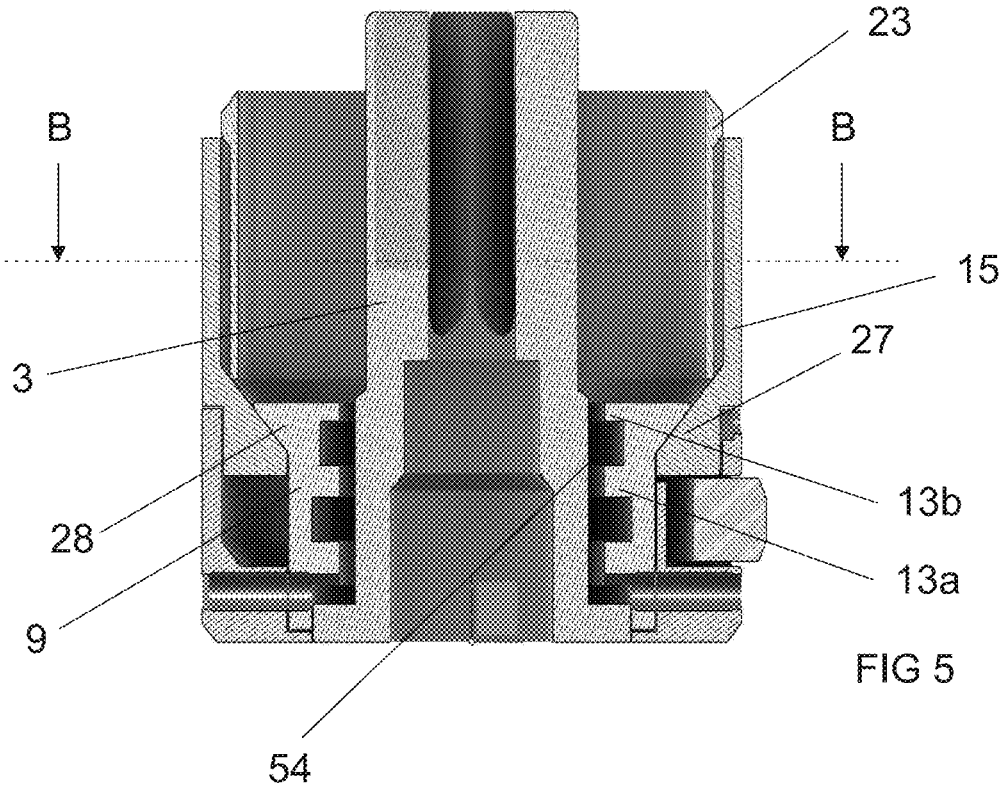
Figure 6:
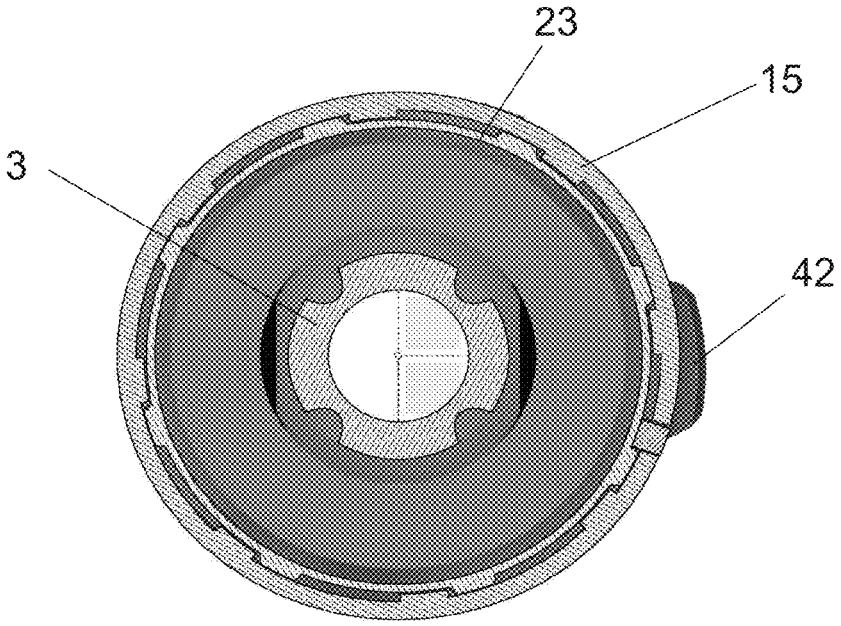
FIG. 6 shows a cross-section of the tubular muzzle adapter along B-B in FIG. 5, FIG. 7 the substantially tubular muzzle adapter, the substantially tubular attachment mount and the substantially tubular clutch collar of an embodiment of the assembly in an assembled state and as cut transversely to the longitudinal axis of the assembly and in a state where the muzzle device is in an unlocking position received in the substantially tubular muzzle adapter.
Figure 7:
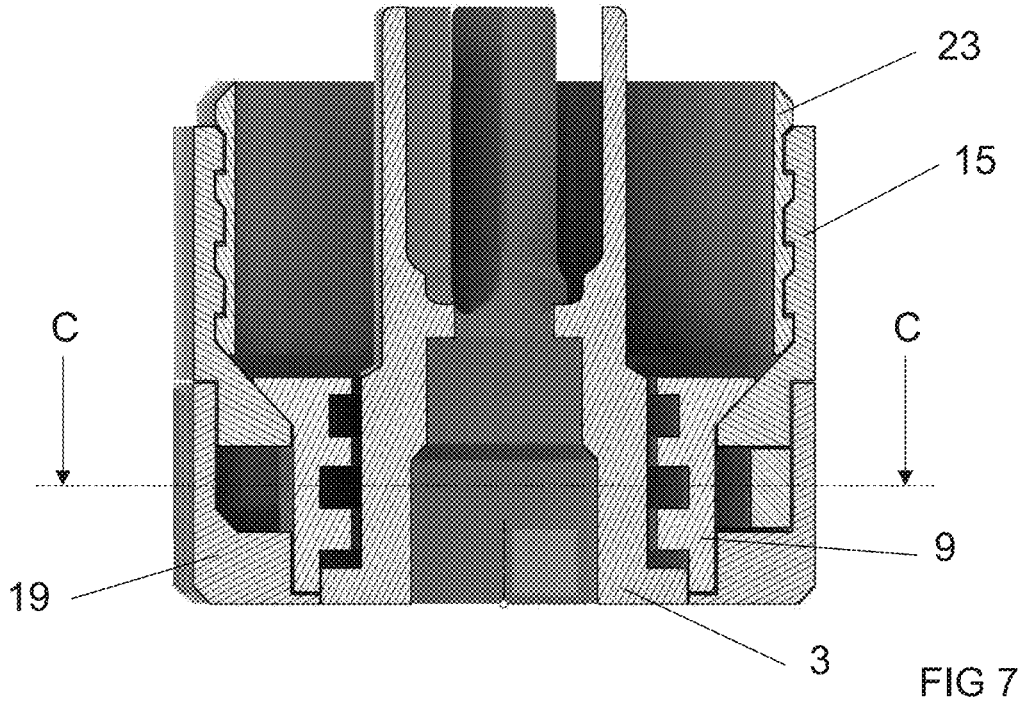
Figure 8:
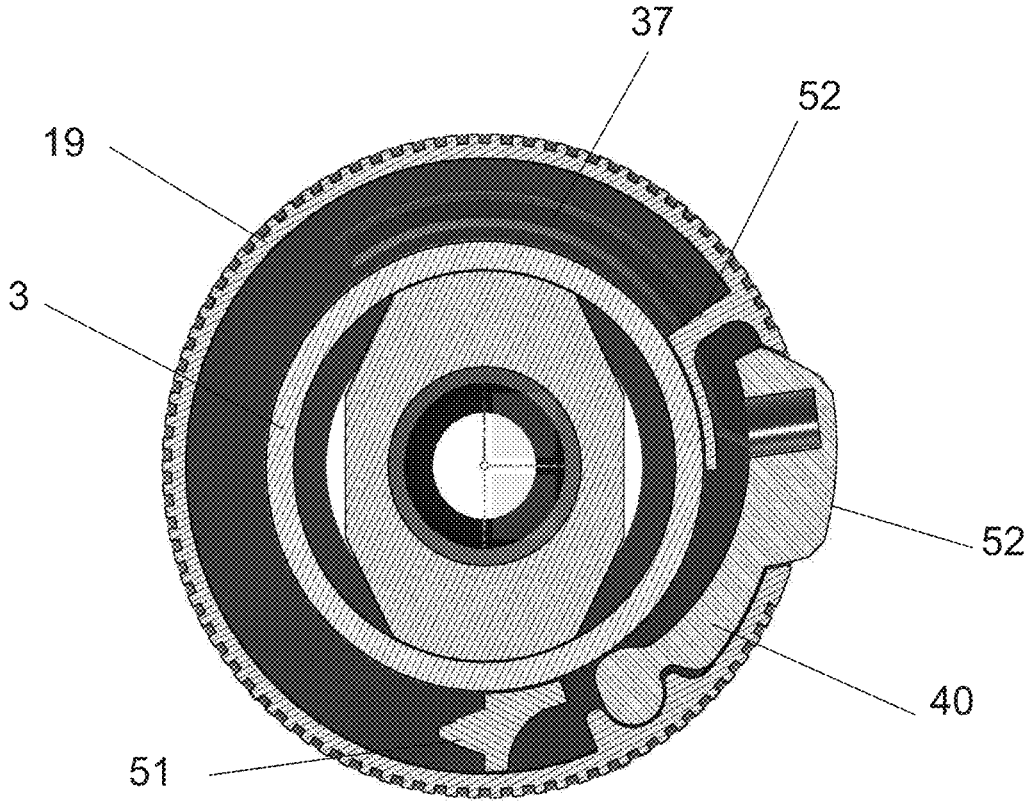
FIG. 8 shows a cross section of the substantially tubular muzzle adapter taken along section C-C in FIG. 7, FIG. 9 the substantially tubular muzzle adapter, the substantially tubular attachment mount and the substantially tubular clutch collar of an embodiment of the assembly an assembled state and as cut transversely to the longitudinal axis of the assembly and in a state where the muzzle device is in a locking position received in the substantially tubular muzzle adapter.
Figure 9:
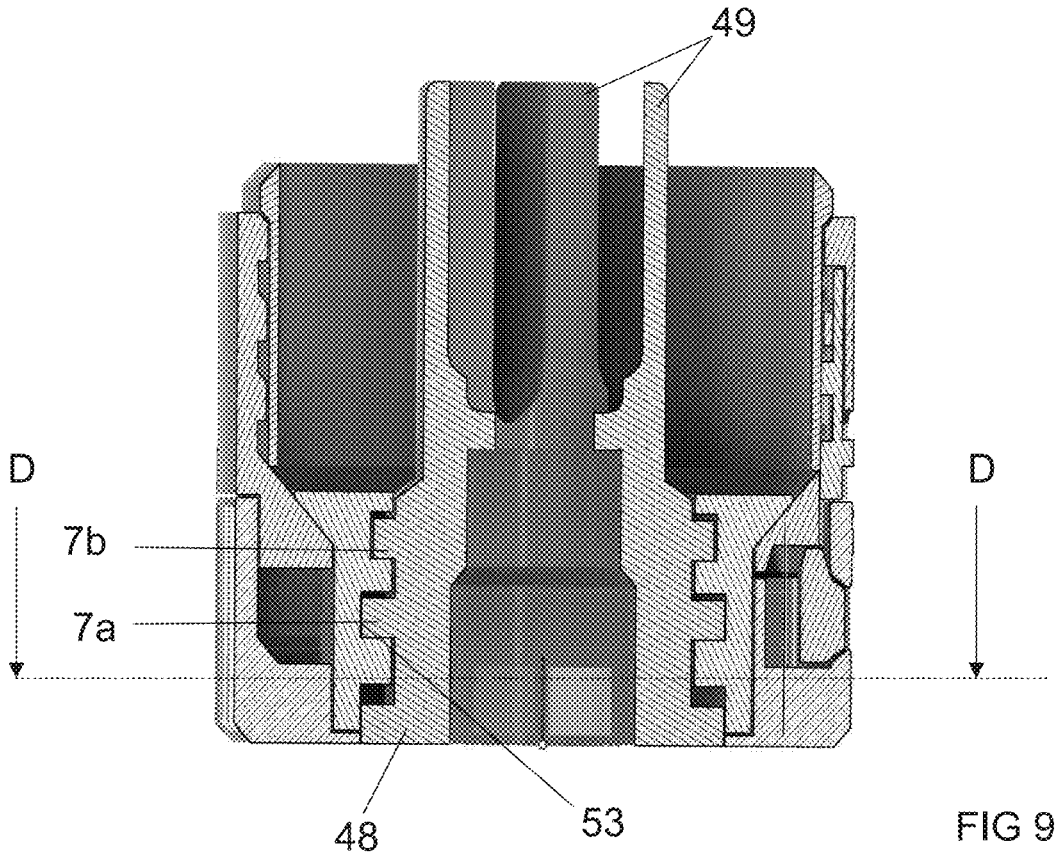
Figure 10:
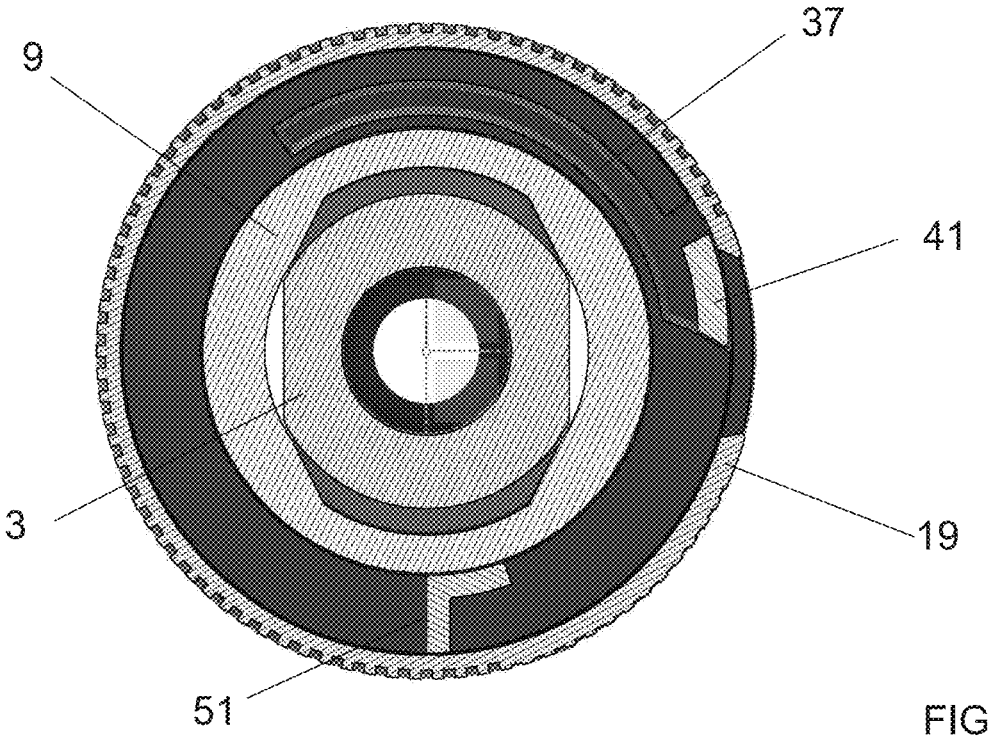
FIG. 10 shows a cross section of the general tubular muzzle adapter taken along section D-D in FIG. 9.
Figure 11:
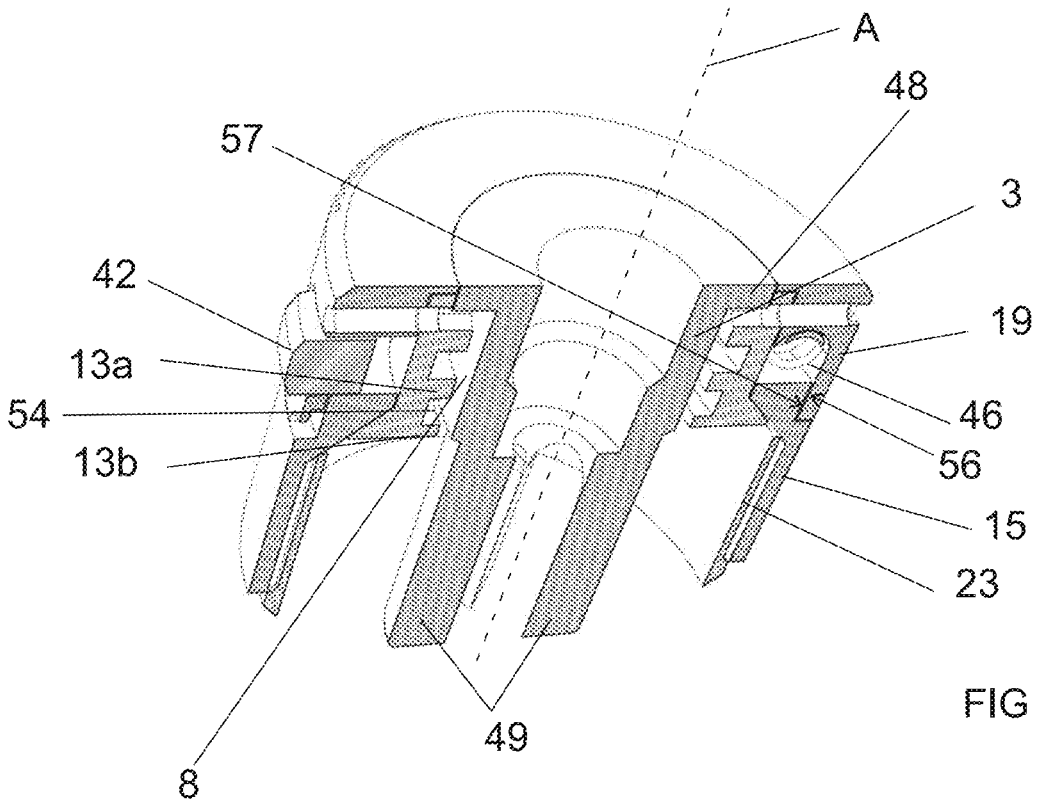
FIG. 11 shows the substantially tubular muzzle adapter, the substantially tubular attachment mount and the substantially tubular clutch collar of an embodiment of the assembly as cut along the longitudinal axis of the assembly and in an assembled state and in a state, where the muzzle device is in an unlocking position received in the substantially tubular muzzle adapter.
Figure 12:
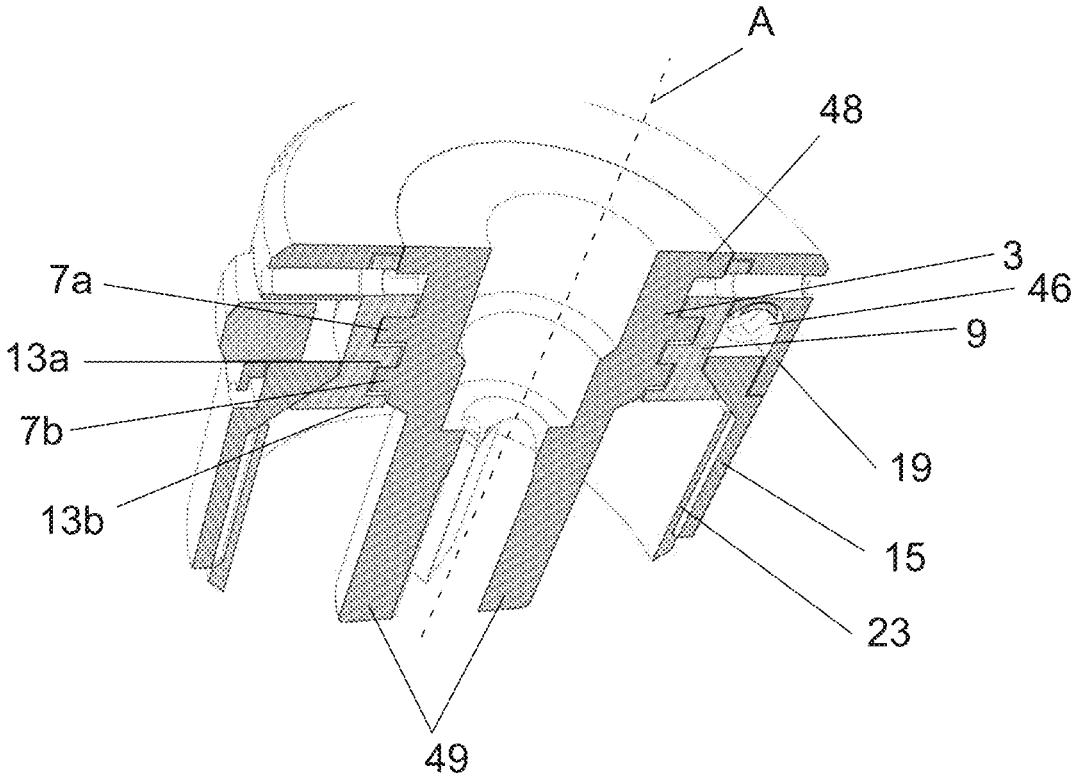
FIG. 12 shows the substantially tubular muzzle adapter, the substantially tubular attachment mount and the substantially tubular clutch collar of an embodiment of the assembly as cut along the longitudinal axis of the assembly and in an assembled state and in a state, where the muzzle device is in a locking position received in the substantially tubular muzzle adapter.
Figure 13:
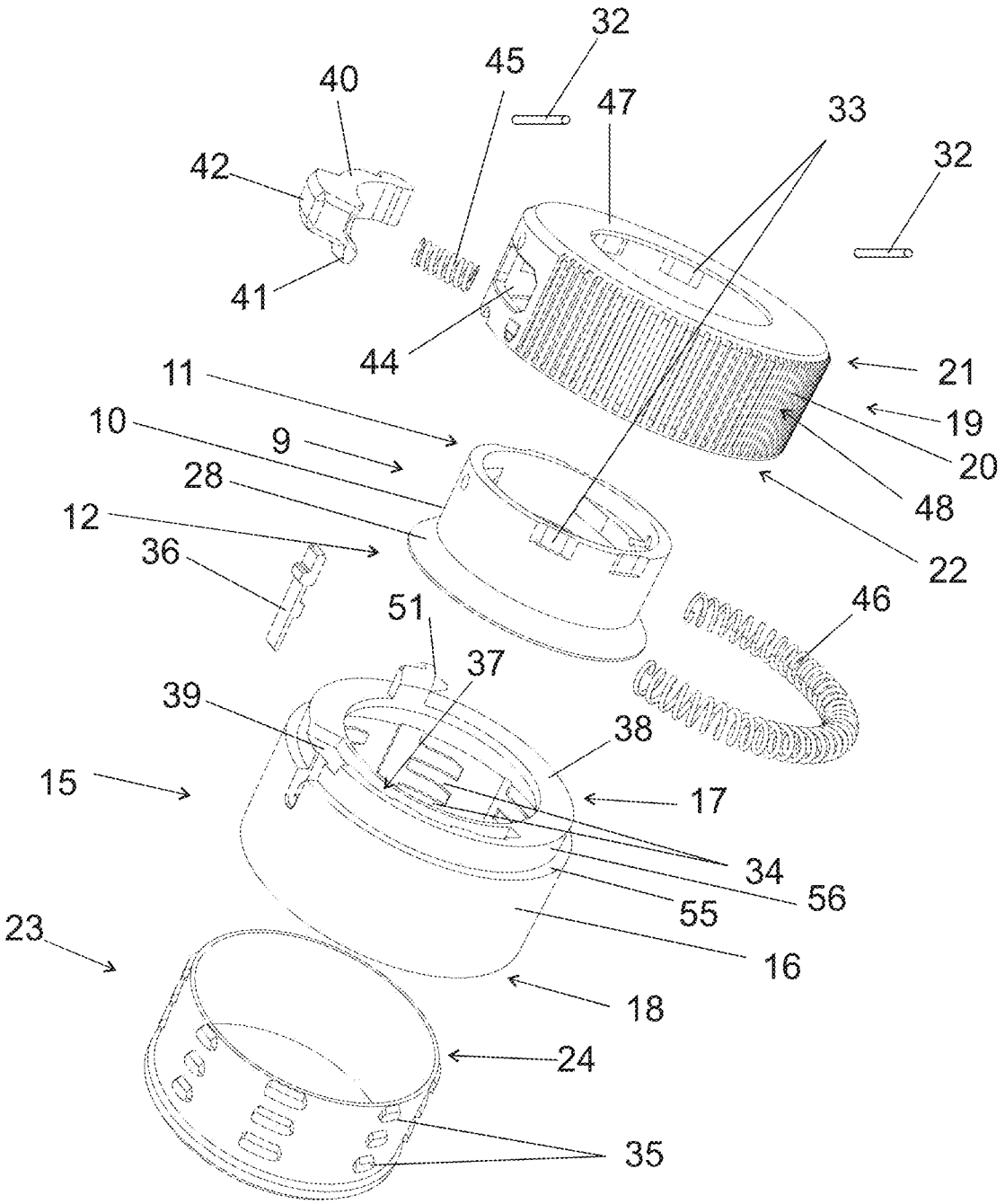
FIG. 13 is an exploded illustration showing parts of an embodiment of the assembly.
Figure 14:
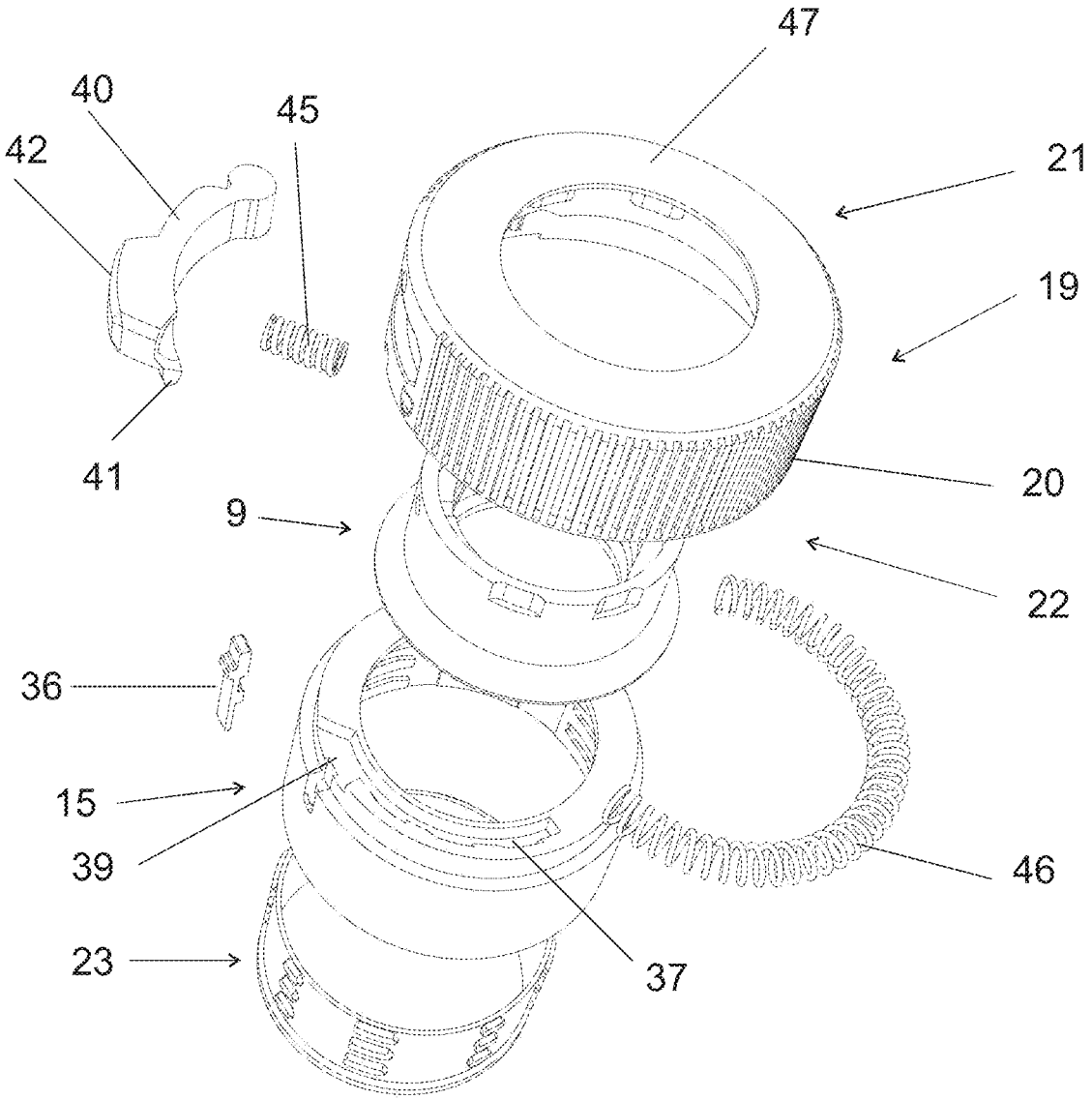
FIG. 14 is an exploded illustration showing parts of an embodiment of the assembly.
Figure 15:
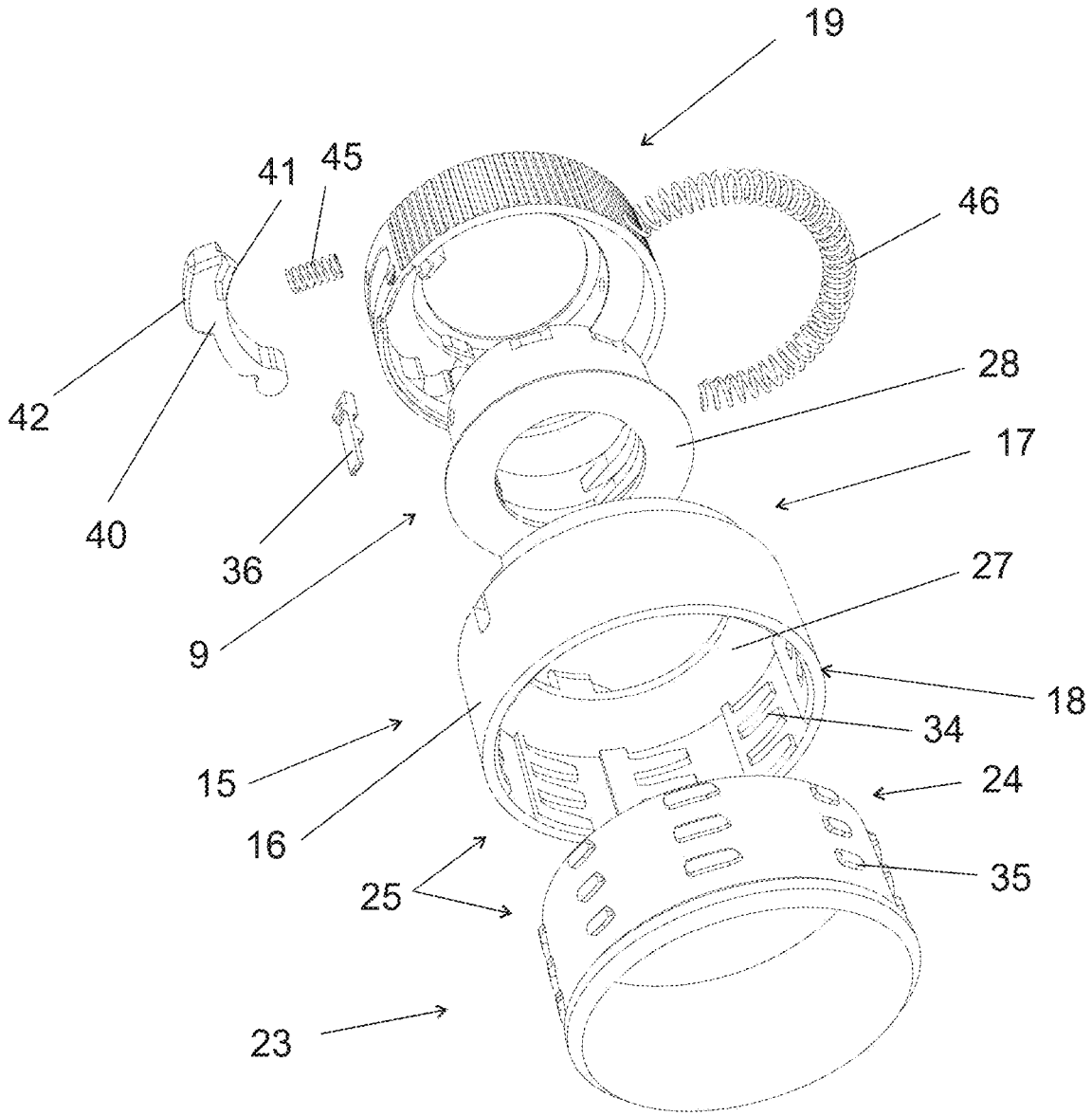
FIG. 15 is an exploded illustration showing parts of an embodiment of the assembly.
Figure 16:
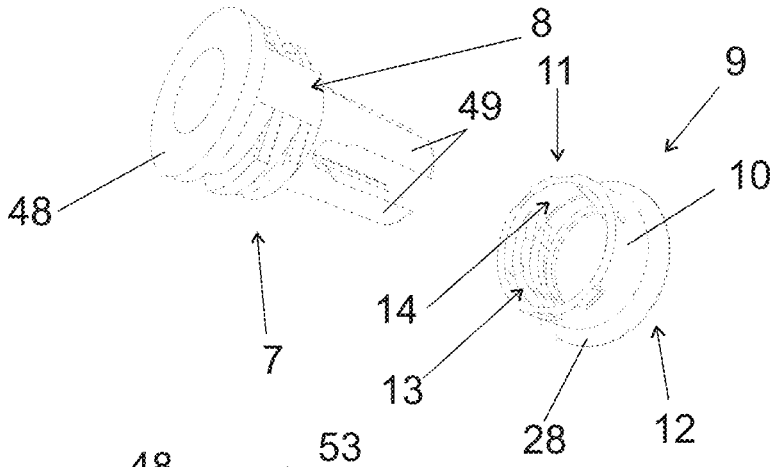
FIG. 16 shows the muzzle device and the substantially tubular muzzle adapter of an embodiment of the assembly.
Figure 17:
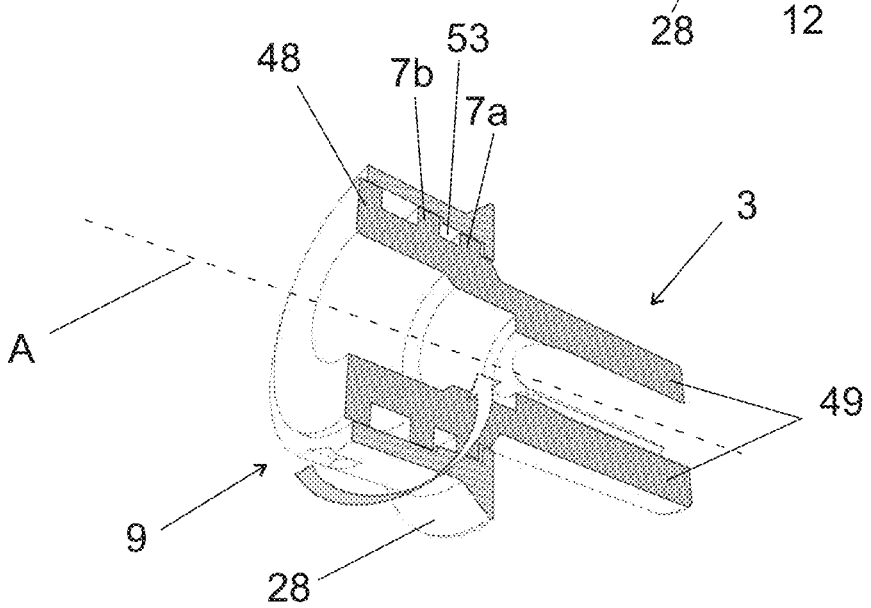
FIG. 17 shows rotation of the muzzle device with respect to the substantially tubular muzzle adapter of an embodiment of the assembly about the longitudinal axis of the assembly from the unlocking position to the locking position.
Figure 18:
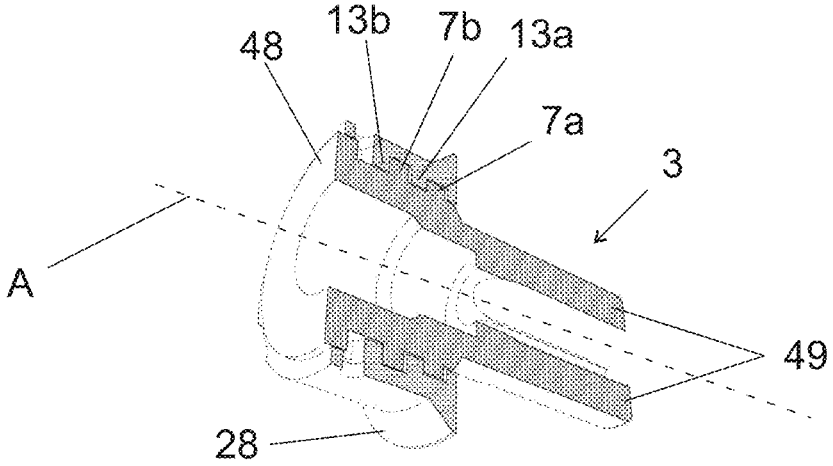
FIG. 18 shows the muzzle device and the substantially tubular muzzle adapter of an embodiment of the assembly as locked together in the locking position.
Figure 19:
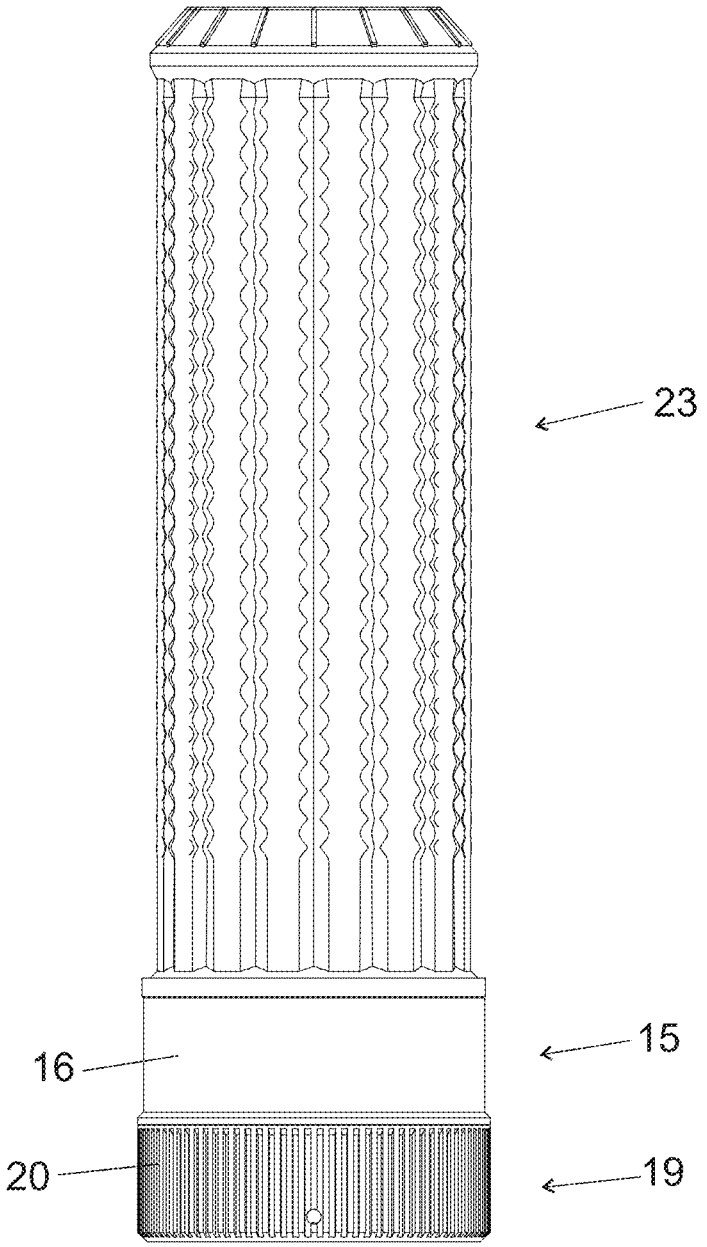
FIG. 19 shows a first embodiment of the assembly.
Figure 20:
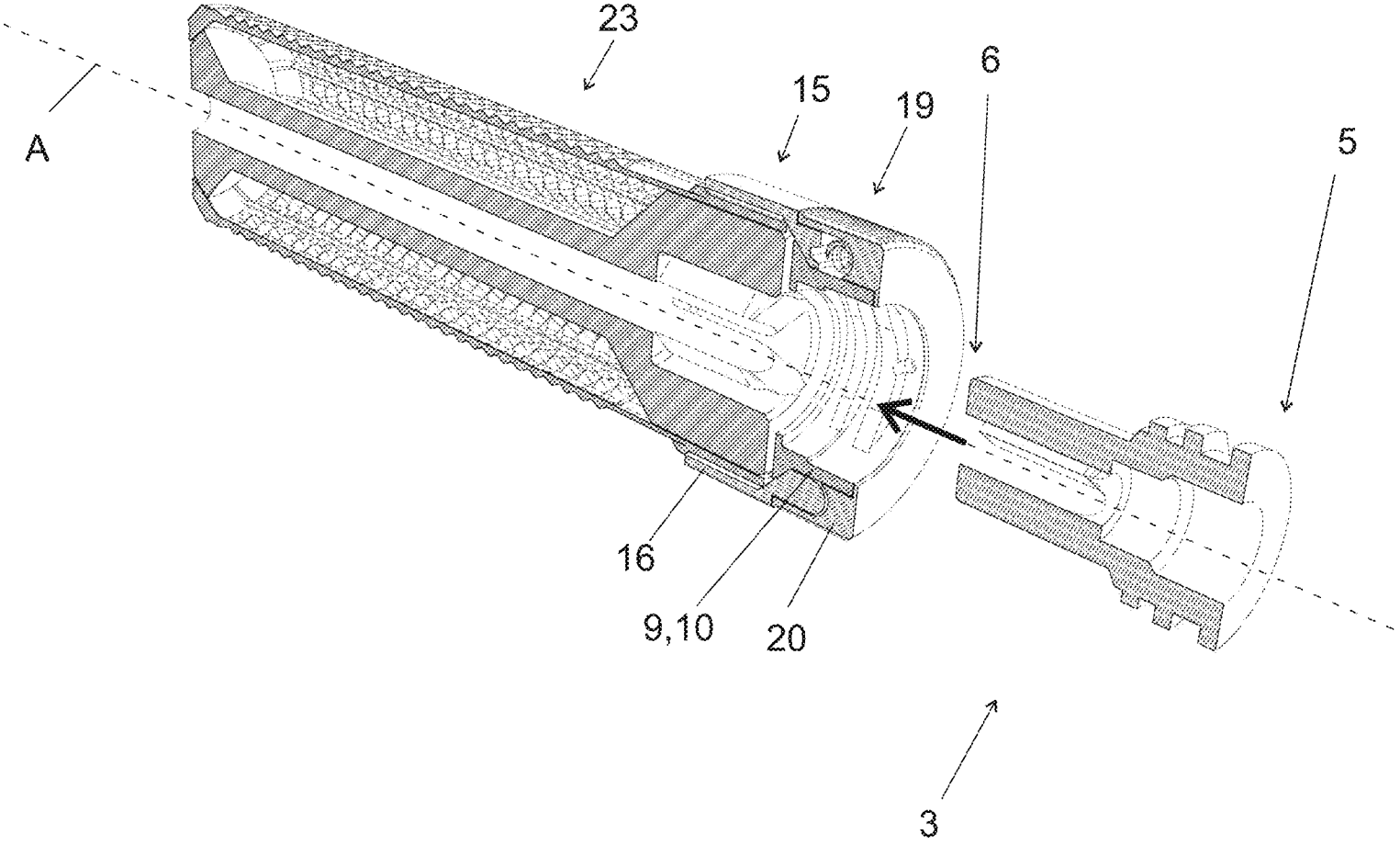
FIG. 20 shows the assembly illustrated in FIG. 19 as cut along the longitudinal axis of the assembly and shows insertion of the muzzle device into the rest of the assembly.
Figure 21:
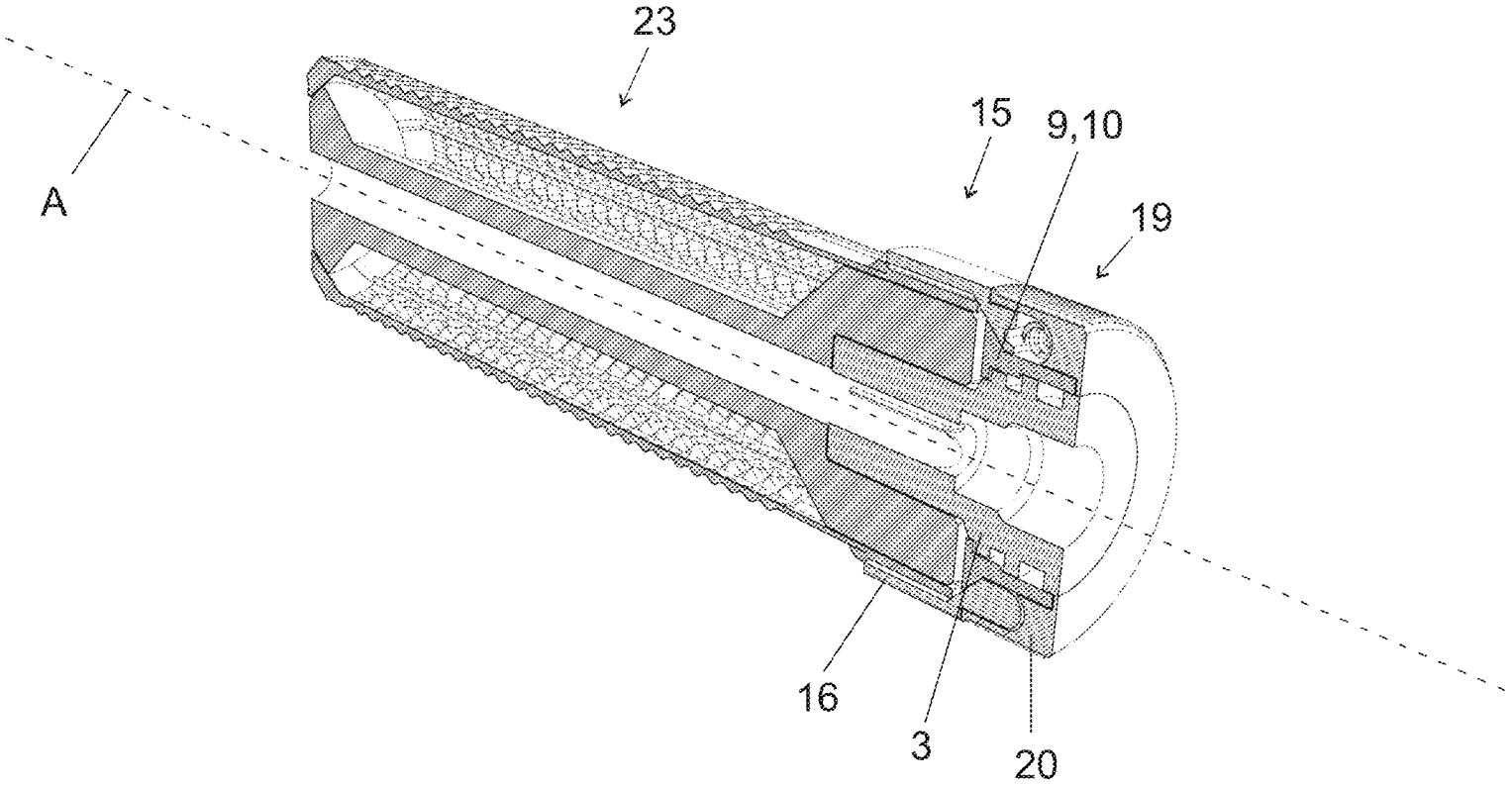
FIG. 21 shows the assembly illustrated in FIG. 19 as cut along the longitudinal axis of the assembly in a state where the muzzle device is in an unlocking position.
Figure 22:
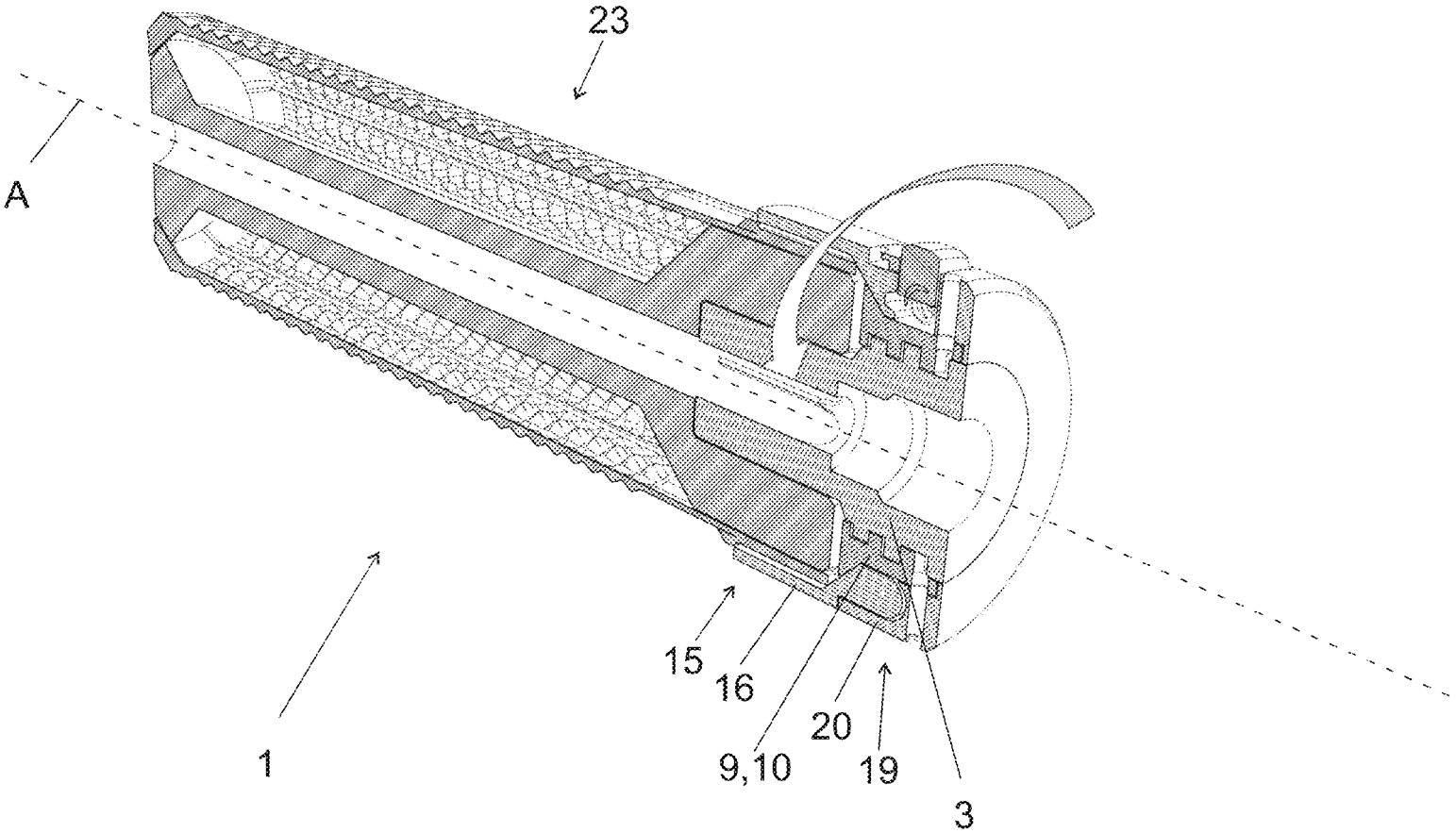
FIG. 22 shows the assembly illustrated in FIG. 19 as cut along the longitudinal axis of the assembly and shows rotation of the muzzle device into the locking position.
Figure 23:
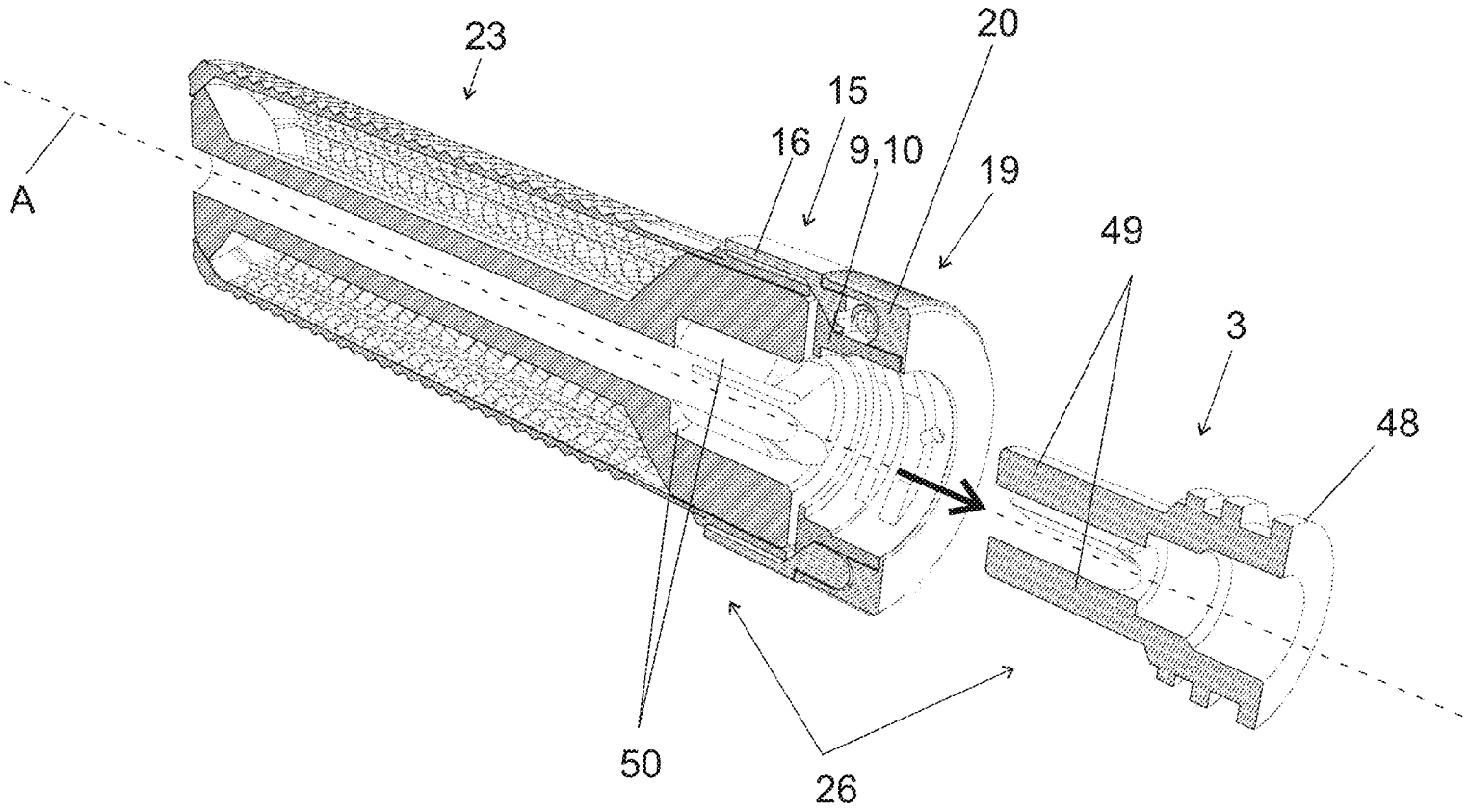
FIG. 23 shows the assembly illustrated in FIG. 19 as cut along the longitudinal axis of the assembly and shows removal of the muzzle device from the rest of the assembly.
Figure 24:
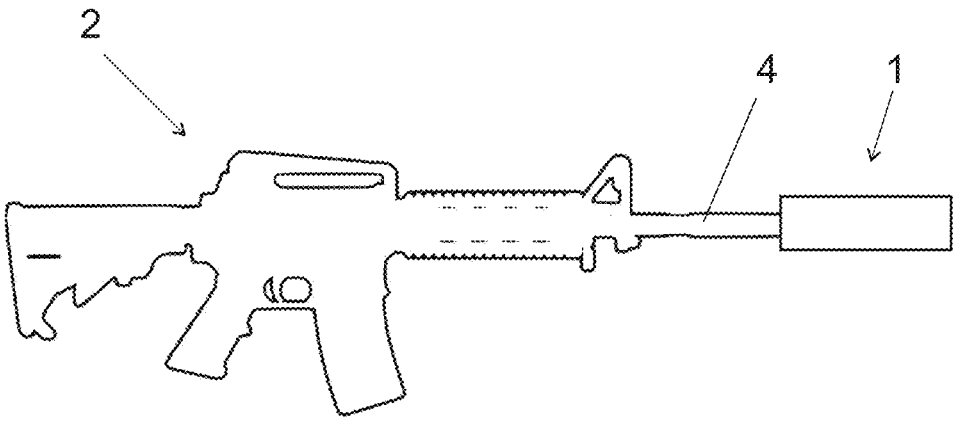
FIG. 24 shows a firearm provided with the assembly.

An assembly 1 for a firearm 2 and some embodiments and variants of the assembly are described below. 1 will be described in greater detail.

The assembly 1 has preferably, but not necessarily, a longitudinal central axis A.

The assembly 1 comprises a muzzle device 3 configured to be attached to a muzzle of a barrel 4 of the firearm 2. The muzzle device 3 has a first proximal end 5, and a first distal end 6. The muzzle device 3 is provided with a number of successive locking teeth 7 and first channels 8 around an outer circumference (not marked with a reference numeral) of the muzzle device 3.

The assembly 1 comprises a substantially tubular muzzle adapter 9 having a first tubular body 10, a second proximal end 11, and a second distal end 12. The substantially tubular muzzle adapter 9 is provided with a number of successive locking lugs 13 and second channels 14 around an inner circumference (not marked with a reference numeral) of the substantially tubular muzzle adapter 9.

The assembly 1 comprises a substantially tubular attachment mount 15 having a second tubular body 16, a third proximal end 17, and a third distal end 18.

The assembly 1 comprises a substantially tubular clutch collar 19 having a third tubular body 20, a fourth proximal end 21, and a fourth distal end 22.

The assembly 1 comprises a device 23 such as a sound suppressor, a blank firing bullet trap, or a reinforcement bar cutter having a fifth proximal end 24.

In the assembly 1, the device 23 is releasably attached to the substantially tubular attachment mount 15 by means of attachment means 25.

Because the device 23 is releasably attached to the substantially tubular attachment mount 15, the device 23 can be changed or replaced with another device 23.

In the assembly 1, the muzzle device 3 is configured to be releasably received in the substantially tubular muzzle adapter 9 so that co-operating rotation prevention means 26 of the muzzle device 3 and at least one of the device 23 and the substantially tubular attachment mount 15 prevents the muzzle device 3 from rotating with respect to the device 23 and/or to the substantially tubular muzzle adapter 9 about the longitudinal central axis A.

In the assembly 1, the muzzle device 3 can, as in the embodiment of the assembly illustrated in FIGS. 19 to 23, be configured to be releasably received in the substantially tubular muzzle adapter 9 so that the first distal end 6 of the muzzle device 3 extends into the fifth proximal end 24 of the device 23. In such case, the co-operating rotation prevention means 26 are preferably, but not necessarily, formed at least partly of tines 49 of the muzzle device 3 and by recesses 50 in the device 23 sized and shaped for complementary receipt of at least a portion of the tines 49 of the muzzle device 3, as in the embodiment of the assembly illustrated in FIGS. 19 to 23.

In the assembly 1, the substantially tubular muzzle adapter 9 is attached to the substantially tubular clutch collar 19 for rotation about the longitudinal central axis A together with the substantially tubular clutch collar 19 and by means of the tubular clutch collar 19 with respect to the device 23, to the muzzle device 3 and to the substantially tubular attachment mount 15 between (i) a locking position, where successive locking teeth 7 of the muzzle device 3 are in the direction of the longitudinal central axis A at least partly aligned with the locking lugs 13 of the substantially tubular muzzle adapter 9 so as to prevent relative movement between the muzzle device 3 and the substantially tubular muzzle adapter 9 in the direction of the longitudinal central axis A, and (ii) an unlocking position, where successive locking teeth 7 of the muzzle device 3 are in the direction of the longitudinal central axis A aligned with the second channels 14 of the substantially tubular muzzle adapter 9 and where successive locking lugs 13 of the substantially tubular muzzle adapter 9 are in the direction of the longitudinal central axis A aligned with the first channels 8 of the muzzle device 3 so as to allow relative movement between the muzzle device 3 and the substantially tubular muzzle adapter 9 in the direction of the longitudinal central axis A.

The assembly can for example be configured to be used and be configured to function as presented in the following: The muzzle device 3 is fastened to the barrel 4 of the firearm 2. The substantially tubular muzzle adapter 9, the substantially tubular attachment mount 15, and the substantially tubular clutch collar 19 as well as other parts of the assembly are assembled together, if not already assembled together. The device 23 is attached to the substantially tubular attachment mount 15. The muzzle device 3 is brought into the substantially tubular muzzle adapter 9 of the assembly 1 from the second proximal end 11 of the substantially tubular muzzle adapter 9. The substantially tubular muzzle adapter 9 is rotated about the longitudinal central axis A with the substantially tubular clutch collar 19 into the unlocking position, where successive locking teeth 7 of the muzzle device 3 are in the direction of the longitudinal central axis A aligned with the second channels 14 of the substantially tubular muzzle adapter 9 and where successive locking lugs 13 of the substantially tubular muzzle adapter 9 are in the direction of the longitudinal central axis A aligned with the first channels 8 of the muzzle device 3 so as to allow relative movement between the muzzle device 3 and the substantially tubular muzzle adapter 9 in the direction of the longitudinal central axis A, whereafter the muzzle device 3 is brought through the muzzle adapter 9 so that the so that the first distal end 6 of the muzzle device 3 extends into the fifth proximal end 24 of the device 23 and so that co-operating rotation prevention means 26 of the muzzle device 3 and at least one of the device 23 and the substantially tubular muzzle adapter 9 prevents the muzzle device 3 from rotating with respect to the device 23 and/or to the substantially tubular muzzle adapter 9 about the longitudinal central axis A. Thereafter the substantially tubular muzzle adapter 9 is manually or automatically rotated about the longitudinal central axis A with the substantially tubular clutch collar 19 from the unlocking position into the locking position, where successive locking teeth 7 of the muzzle device 3 are in the direction of the longitudinal central axis A at least partly aligned with the locking lugs 13 of the substantially tubular muzzle adapter 9 so as to prevent relative movement between the muzzle device 3 and the substantially tubular muzzle adapter 9 in the direction of the longitudinal central axis A.

The muzzle device 3 has preferably, but not necessarily, a threaded inner surface (not illustrated) extending from the first proximal end 5. A purpose of such threaded inner surface is to allow fastening of the muzzle device 3 to the barrel 4 of the firearm 2 by screwing the muzzle device 3 onto outer threads provided at the end of the barrel 4 of the firearm 2.

The muzzle device 3 can have a flange 48 at the first proximal end 5.

The muzzle device 3 can for example be one of a muzzle brake, a flash suppressor, and a flash hider.

The muzzle device 3 can be provided with tines 49.

The substantially tubular attachment mount 15 has preferably, but not necessarily, a first radially inwardly projecting flange 27 at the third proximal end 17, wherein the first radially inwardly projecting flange 27 tapers in steps, arcuately and/or linearly towards the third proximal end 17, and the substantially tubular muzzle adapter 9 has preferably, but not necessarily, a radially outwardly projecting flange 28 at the second distal end 12, wherein the radially outwardly projecting flange 28 tapers in steps, arcuately and/or linearly towards the second proximal end 11, and the radially outwardly projecting flange 28 of the substantially tubular muzzle adapter 9 circumferentially abuts preferably, but not necessarily, the first radially inwardly projecting flange 27 of the substantially tubular attachment mount 15. A purpose of such radially outwardly projecting flange 28 and of such first radially inwardly projecting flange 27 is to align the substantially tubular attachment mount 15 and the substantially tubular muzzle adapter 9 preferably, but not necessarily, with respect to the longitudinal central axis A.

The fourth proximal end 21 of the third tubular body 20 of the substantially tubular clutch collar 19 is preferably, but not necessarily, attached to the second proximal end 11 of the first tubular body 10 of the substantially tubular muzzle adapter 9. It is possible, as in the embodiment of the assembly 1 illustrated in the figures, that the substantially tubular clutch collar 19 has first throughgoing locking holes 30 in the third tubular body 20 at the fourth proximal end 21, and that the substantially tubular muzzle adapter 9 has second throughgoing locking holes 31 in the first tubular body 10 at the second proximal end 11, and that at least one first throughgoing locking hole 30 of the substantially tubular muzzle adapter 9 and at least one second throughgoing locking hole 31 in the substantially tubular clutch collar 19 are aligned, and that a fastening means 32 is provided in said at least one first throughgoing locking hole 30 of the substantially tubular muzzle adapter 9 and in said at least one second throughgoing locking hole 31 in the substantially tubular clutch collar 19 to fasten the substantially tubular muzzle adapter 9 to the substantially tubular clutch collar 19. The second proximal end 11 of the substantially tubular muzzle adapter 9 and the fourth proximal end 21 of the substantially tubular clutch collar 19 comprise preferably, but not necessarily, cooperating locking projections and grooves 33 for preventing the substantially tubular clutch collar 19 from rotating with respect to the substantially tubular muzzle adapter 9 about the longitudinal central axis A.

In the assembly, the fifth proximal end 24 of the device 23 can, as in the embodiments illustrated in the figures, be releasably received in the third distal end 18 of the substantially tubular attachment mount 15.

The attachment means 25 by means of which the device 23 is releasably attached to the substantially tubular attachment mount 15 comprises preferably, but not necessarily, bayonet grooves 34 at one of the second tubular body 16 of the substantially tubular attachment mount 15 and the device 23 and projections 35 for cooperation with the bayonet grooves 34 at the other of the second tubular body 16 of the substantially tubular attachment mount 15 and the device 23. An openable and closable locking means 36 for locking the device 23 in position with respect to the substantially tubular attachment mount 15, when the projections 35 are received in the bayonet grooves 34, is preferably, but not necessarily, provided. The openable and closable locking means 36 can for example, as illustrated in the figures, comprise a sliding member (not marked with a reference numeral) that is movable arranged in a groove (not marked with a reference numeral) provided in the substantially tubular attachment mount 15.

Figure 25:
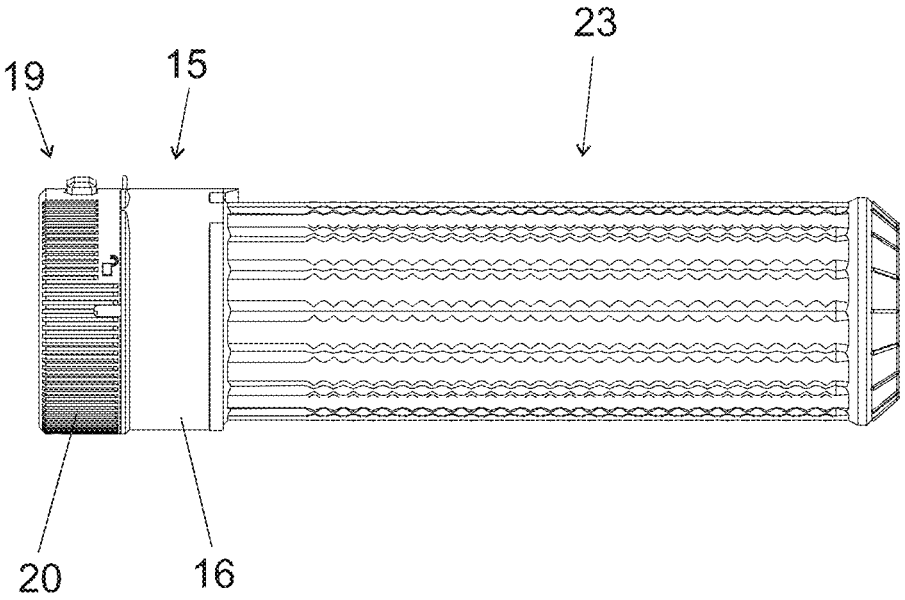
FIG. 25 shows a second embodiment of the assembly.
Figure 26:
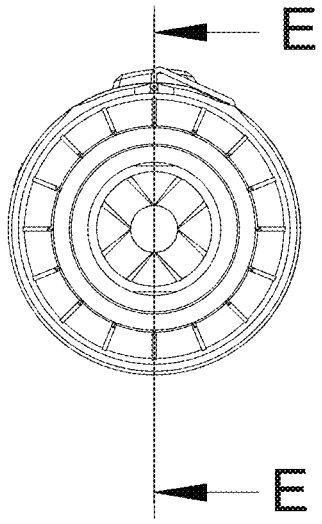
FIG. 26 shows the assembly illustrated in FIG. 25 as seen from the first proximal end of the muzzle device.
Figure 27:
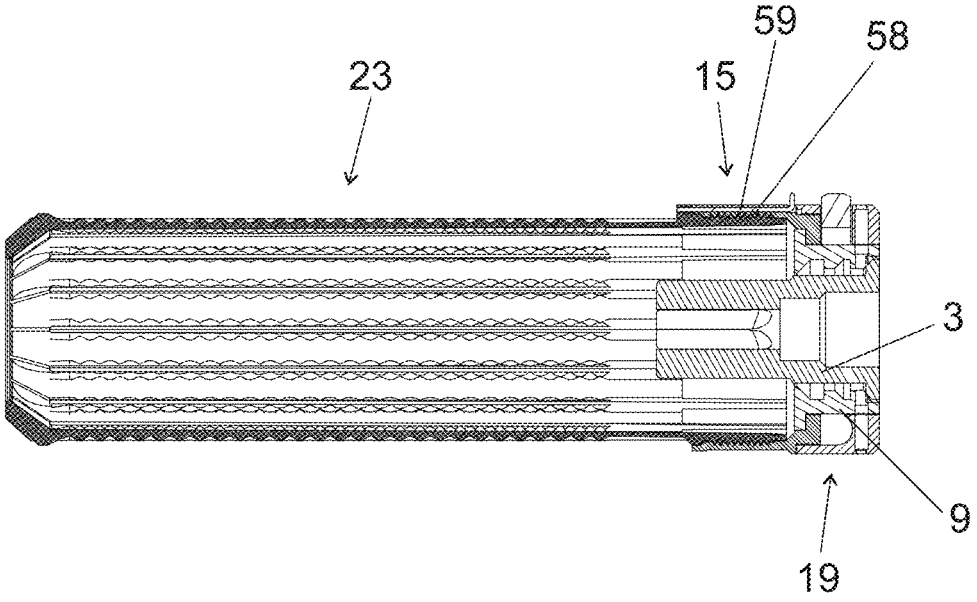
FIG. 27 shows a cross section of the assembly illustrated in FIG. 25 as cut along plane E-E in FIG. 26.

Alternatively to bayonet grooves 34 and projections 35 for cooperation with the bayonet grooves, the attachment means 25 can for example as in the embodiment of the assembly illustrated in FIGS. 25 to 27 comprise an inner threading 58 on the second tubular body 16 of the substantially tubular attachment mount 15 and an outer threading 59 on the device 23 for co-operation with the inner threading 58 on the second tubular body 16 of the substantially tubular attachment mount 15. An openable and closable locking means 36 (not illustrated in the FIGS. 25 to 27) for locking the device 23 in position with respect to the substantially tubular attachment mount 15, when the device 23 is releasable attached to the substantially tubular attachment mount 15 by means of the outer threading 59 and the inner threading 58 of the attachment means 25 is preferably, but not necessarily, provided.

Alternatively to bayonet grooves 34 and projections 35 for cooperation with the bayonet grooves and alternatively to that what is shown in FIGS. 25 to 27, the attachment means 25 can for example comprise an outer threading (not illustrated in the figures) on the second tubular body 16 of the substantially tubular attachment mount 15 and an inner threading (not illustrated in the figures) on the device 23 for co-operation with the outer threading on the second tubular body 16 of the substantially tubular attachment mount 15. An openable and closable locking means 36 for locking the device 23 in position with respect to the substantially tubular attachment mount 15, when the device 23 is releasable attached to the substantially tubular attachment mount 15 by means of the outer threading and the inner threading of the attachment means 25 is preferably, but not necessarily, provided.

An arc-shaped groove 37 is preferably, but not necessarily, as in some of the embodiments of the assembly 1 illustrated in the figures, provided in an end surface 38 at the second proximal end 11 of the substantially tubular attachment mount 15, wherein the arc-shaped groove 37 has a locking recess 39. A spring arm 40 with a locking nose 41 and a button 42 is preferably, but not necessarily, as in some of the embodiments of the assembly 1 illustrated in the figures, pivotally connected to the third inner surface 43 of the substantially tubular clutch collar 19 so that the button 42 of the spring arm 40 extends through an opening 44 in the third tubular body 20 of the substantially tubular clutch collar 19. The spring arm 40 is preferably, but not necessarily, pivotally connected to the third inner surface 43 of the substantially tubular clutch collar 19 at a seat (not marked with a reference numeral) provided at to the third inner surface 43 of the substantially tubular clutch collar 19. A first spring 45 is preferably, but not necessarily, as in some of the embodiments of the assembly 1 illustrated in the figures, provided and configured to press the button 42 of the spring arm 40 through the opening 44 in the third tubular body 20 of the substantially tubular clutch collar 19. The locking nose 41 of the spring arm 40 is configured to move in the arc-shaped groove 37 in the end surface 38 of the substantially tubular attachment mount 15 when the substantially tubular muzzle adapter 9 together with the substantially tubular clutch collar 19 is rotated about the longitudinal central axis A with respect to the substantially tubular attachment mount 15, to the muzzle device 3, and to the device 23 between the locking position and the unlocking position. Rotating of the substantially tubular muzzle adapter 9 together with the substantially tubular clutch collar 19 with respect to the substantially tubular attachment mount 15, to the muzzle device 3, and to the device 23 about the longitudinal central axis A is prevented by rotating the substantially tubular muzzle adapter 9 together with the substantially tubular clutch collar 19 with respect to the substantially tubular attachment mount 15 into the locking position resulting in that the locking nose 41 of the spring arm 40 enters the locking recess 39 of the arc-shaped groove, and wherein the locking nose 41 of the spring arm 40 can be brought out of the locking recess 39 of the arc-shaped groove 37 by pressing the button 42 of the spring arm 40.

The assembly 1 comprises preferably, but not necessarily, a second spring 46 that is configured to be loaded when the substantially tubular clutch collar 19 together with the circular muzzle adapter 9 is rotated about the longitudinal central axis A with respect to the circular attachment mount 15, to the muzzle device 3, and to the device 23 in direction away from the locking position. Such second spring 46 can, as illustrated in FIGS. 3 and 13 to 15, be a compression spring that is provided between a first abutment 51 provided at the second proximal end 11 of the substantially tubular attachment mount 15 and a second abutment 52 provided at the third inner surface 43 of the substantially tubular clutch collar 19 and that is configured to be compressed and loaded with energy when the when the substantially tubular clutch collar 19 together with the circular muzzle adapter 9 is rotated about the longitudinal central axis A with respect to the circular attachment mount 15, to the muzzle device 3, and to the device 23 in direction away from the locking position. Said energy that is loaded into the second spring 46 is configured to rotate the substantially tubular clutch collar 19 together with the circular muzzle adapter 9 about the longitudinal central axis A with respect to the circular attachment mount 15, to the muzzle device 3, and to the device 23 back to the locking position or back towards the locking position.

The substantially tubular clutch collar 19 has preferably, but not necessarily, a second radially inwardly projecting flange 47 at the fourth proximal end 21.

A profiling 48 is preferably, but not necessarily, provided at an outer surface of the substantially tubular clutch collar 19. A purpose of the profiling 48 is to promote gripping of the substantially tubular clutch collar 19.

Said number of successive locking teeth 7 and first channels 8 around the outer circumference of the muzzle device 3 comprises preferably, but not necessarily, successive locking teeth of a first locking teeth type 7*a* and first channels 8 around the outer circumference of the muzzle device 3 at a first axial location of the muzzle device 3 and successive locking teeth of a second locking teeth type 7*b* and first channels 8 around the outer circumference of the muzzle device 3 at a second axial location of the muzzle device 3, wherein the locking teeth 7 of the first locking teeth type 7*a* and the locking teeth 7 of the second locking teeth type 7*b* are separated by a first groove 53 in the axial direction of the muzzle device 3 and wherein the locking teeth 7 of the first locking teeth type 7*a* have a design that differs from the design of the locking teeth 7 of the second locking teeth type 7*b*. Said number of successive locking lugs 13 and second channels 14 around the inner circumference of the substantially tubular muzzle adapter 9 comprises preferably, but not necessarily, successive locking lugs of a first locking lugs type 13*a* and second channels 14 around the inner circumference of substantially tubular muzzle adapter 9 at a first axial location of the substantially tubular muzzle adapter 9 and successive locking lugs of a second locking lugs type 13*b* and second channels 14 around the inner circumference of the substantially tubular muzzle adapter 9 at a second axial location of the substantially tubular muzzle adapter 9, wherein the locking lugs 13 of the first locking lugs type 13*a* and the locking lugs 13 of the second locking lugs type 13*b* are separated by a second groove 54 in the axial direction of the substantially tubular muzzle adapter 9, and wherein the locking lugs 13 of the first locking lugs type 13*a* have a design that differs from the design of the locking lugs 13 of the second locking lugs type 13*b*. The locking teeth 7 of the first locking teeth type 7*a* have a design and the locking teeth 7 of the second locking teeth type 7*b* have a design that prevents one of the locking teeth 7 of the first locking teeth type 7*a* and the locking teeth 7 of the second locking teeth type 7*b* from entering the second groove 54 but that allows the other of locking teeth 7 of the first locking teeth type 7*a* and the locking teeth 7 of the second locking teeth type 7*b* to enter the second groove 54 when the muzzle device 3 is rotated with respect to the substantially tubular muzzle adapter 9 about the longitudinal central axis A. The locking lugs 13 of the first locking lug type 13*a* have a design and the locking lugs 13 of the second locking lug type 13*b* have a design that prevents one of the locking lugs 13 of the first locking lug type 13*a* and the locking lugs 13 of the second locking lug type 13*b* from entering the first groove 53 but that allows the other of the locking lugs 13 of the first locking lug type 13*a* and the locking lugs 13 of the second locking lug type 13*b* to enter the first groove 53 when the muzzle device 3 is rotated with respect to the substantially tubular muzzle adapter 9 about the longitudinal central axis A. A purpose of this is to ensure correct connection between the substantially tubular muzzle adapter 9 and the muzzle device 3.

In the assembly, the second distal end 12 of the substantially tubular muzzle adapter 9 can be received in the substantially tubular attachment mount 15 and the second proximal end 11 of the substantially tubular muzzle adapter 9 can be received in the substantially tubular clutch collar 19.

In the assembly, the second distal end 12 of the substantially tubular muzzle adapter 9 can be surrounded by the substantially tubular attachment mount 15 and the second proximal end 11 of the substantially tubular muzzle adapter 9 can be surrounded by the substantially tubular clutch collar 19.

In the assembly the third proximal end 17 of the substantially tubular attachment mount 19 can be received in the substantially tubular clutch collar 19.

In the assembly, the third proximal end 17 of the substantially tubular attachment mount 19 being surrounded by the substantially tubular clutch collar 19.

In the assembly, the second tubular body 16 of the substantially tubular attachment mount 15 can, as illustrated in the figures, have at the third proximal end 17 of the substantially tubular attachment mount 15 a shoulder 55 at the outer surface of the second tubular body 16 of the substantially tubular attachment mount 15 and an outer surrounding guiding surface 56 at the outer surface of the second tubular body 16 of the substantially tubular attachment mount 15 between the shoulder 55 and the third proximal end 17 of the substantially tubular attachment mount 15, wherein the fourth distal end 22 of the substantially tubular clutch collar 19 abuts the shoulder 55, and wherein an inner surrounding guiding surface 57 of the third tubular body 20 at the fourth distal end 22 of the third tubular body 20 of the substantially tubular clutch collar 19 circumferentially abuts the outer surrounding guiding surface 56 at the outer surface of the second tubular body 16 of the substantially tubular attachment mount 15.

At least one of the muzzle device 3, the substantially tubular muzzle adapter 9, the substantially tubular attachment mount 15, the substantially tubular clutch collar 19, and the device 23 is preferably, but not necessarily, made of metal or is preferably, but not necessarily, at least partly made of metal.

It is apparent to a person skilled in the art that as technology advanced, the basic idea of the invention can be implemented in various ways. The invention and its embodiments are therefore not restricted to the above examples, but they may vary within the scope of the claims.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both, unless the disclosure states otherwise. The term substantially means the characteristic or dimension deviates by no more than 15%, unless substantially described differently in a particular context. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. An assembly for a firearm comprising:

a muzzle device configured to be attached to a barrel of the firearm, wherein the muzzle device includes a first proximal end and a first distal end, wherein the muzzle device includes successive locking teeth and first channels around an outer circumference of the muzzle device, a substantially tubular muzzle adapter including a first tubular body, a second proximal end, and a second distal end, wherein the muzzle adapter includes successive locking lugs and second channels around an inner circumference of the substantially tubular muzzle adapter, a substantially tubular attachment mount having at least one second tubular body, a third proximal end, and a third distal end, a substantially tubular clutch collar having a third tubular body, a fourth proximal end, and a fourth distal end, and a sound suppressing device having a fifth proximal end, wherein the sound suppressing device is releasably attached to the substantially tubular attachment mount by an attachment device, wherein the muzzle device is configured to be releasably received in the muzzle adapter so that a co-operating rotation prevention device of the muzzle device and at least one of the sound suppressing device and the substantially tubular attachment mount prevents the muzzle device from rotating with respect to the sound suppressing device and/or to the substantially tubular muzzle adapter about the longitudinal central axis A, and wherein the substantially tubular muzzle adapter is attached to the substantially tubular clutch collar for rotation about the longitudinal central axis A together with the substantially tubular clutch collar with respect to the sound suppressing device, to the muzzle device and to the substantially tubular attachment mount between (i) a locking position, where successive locking teeth of the muzzle device are in a direction of the longitudinal central axis A at least partly aligned with the locking lugs of the substantially tubular muzzle adapter to prevent relative movement between the muzzle device and the substantially tubular muzzle adapter in the direction of the longitudinal central axis A, and (ii) an unlocking position, where successive locking teeth of the muzzle device are in the direction of the longitudinal central axis A aligned with the second channels of the substantially tubular muzzle adapter and where successive locking lugs of the substantially tubular muzzle adapter are in the direction of the longitudinal central axis A aligned with the first channels of the muzzle device to allow relative movement between the muzzle device and the substantially tubular muzzle adapter in the direction of the longitudinal central axis A.

2. The assembly according to claim 1, wherein: the muzzle device includes a threaded inner surface extending from the first proximal end.

3. The assembly according to claim 1, wherein:

the substantially tubular attachment mount including a first radially inwardly projecting flange at the third proximal end, wherein the first radially inwardly projecting flange tapers towards the third proximal end, the substantially tubular muzzle adapter includes a radially outwardly projecting flange at the second distal end, wherein the radially outwardly projecting flange tapers towards the second proximal end, and the radially outwardly projecting flange of the substantially tubular muzzle adapter circumferentially abuts the first radially inwardly projecting flange of the substantially tubular attachment mount.

4. The assembly according to claim 1, wherein:

the substantially tubular clutch collar includes first throughgoing locking holes in the third tubular body at the fourth proximal end, the substantially tubular muzzle adapter includes second throughgoing locking holes in the first tubular body at the second proximal end, and at least one first throughgoing locking hole of the substantially tubular muzzle adapter and at least one second throughgoing locking hole in the substantially tubular clutch collar are aligned and a fastener is provided in said at least one first throughgoing locking hole of the substantially tubular muzzle adapter and said at least one second throughgoing locking hole in the substantially tubular clutch collar to fasten the substantially tubular muzzle adapter to the substantially tubular clutch collar.

5. The assembly according to claim 1, wherein:

the second proximal end of the substantially tubular muzzle adapter and the fourth proximal end of the substantially tubular clutch collar comprise cooperating locking projections and grooves configured to prevent the substantially tubular clutch collar from rotating with respect to the substantially tubular muzzle adapter about the longitudinal central axis A.

6. The assembly according to claim 1, wherein:

the fifth proximal end of the sound suppressing device is releasably received in the third distal end of the substantially tubular attachment mount.

7. The assembly according to claim 1, wherein:

the attachment device comprises bayonet grooves at one of the second tubular body of the substantially tubular attachment mount and the sound suppressing device and projections for cooperation with the bayonet grooves at another of the second tubular body of the substantially tubular attachment mount and the sound suppressing device, providing an openable and closable lock to lock the sound suppressing device in position with respect to the substantially tubular attachment mount, when the projections are received in the bayonet grooves.

8. The assembly according to claim 1, wherein:

the attachment device comprises an inner threading or an outer threading on the second tubular body of the substantially tubular attachment mount and an outer threading or an inner threading on the sound suppressing device for co-operation with the inner threading or the outer threading on the second tubular body of the substantially tubular attachment mount, providing an openable and closable lock to lock the sound suppressing device in position with respect to the substantially tubular attachment mount, when the sound suppressing device is releasable attached to the substantially tubular attachment mount by means the outer threading and the inner threading of the attachment device.

9. The assembly according to claim 1, wherein:

an arc-shaped groove in an end surface at the third proximal end of the substantially tubular attachment mount, wherein the arc-shaped groove includes a locking recess, a spring arm with a locking nose and a button pivotally connected to third inner surface of the substantially tubular clutch collar so that the button of the spring arm extends through an opening in the third tubular body of the substantially tubular clutch collar, and a first spring configured to press the button of the spring arm through the opening in the third tubular body of the substantially tubular clutch collar, wherein the locking nose of the spring arm is configured to move in the arc-shaped groove in the end surface of the substantially tubular attachment mount when the substantially tubular muzzle adapter and the substantially tubular clutch collar are rotated about the longitudinal central axis A with respect to the substantially tubular attachment mount, to the muzzle device, and to the sound suppressing device between the locking position and the unlocking position, and wherein rotating of the substantially tubular muzzle adapter together with the substantially tubular clutch collar with respect to the substantially tubular attachment mount, to the muzzle device, and to the sound suppressing device about the longitudinal central axis A is prevented by rotating the substantially tubular muzzle adapter together with the substantially tubular clutch collar with respect to the substantially tubular attachment mount into the locking position resulting in that the locking nose of the spring arm enters the locking recess of the arc-shaped groove, and wherein the locking nose of the spring arm is moved from the locking recess of the arc-shaped groove by pressing the button of the spring arm.

10. The assembly according to claim 1, wherein:

a second spring configured to be loaded when the substantially tubular clutch collar and the tubular muzzle adapter are rotated about the longitudinal central axis A with respect to the tubular attachment mount, to the muzzle device, and to the sound suppressing device in direction away from the locking position.

11. The assembly according to claim 1, wherein:

the substantially tubular clutch collar includes a second radially inwardly projecting flange at the fourth proximal end.

12. The assembly according to claim 1, wherein:

a profiling at an outer surface of the substantially tubular clutch collar.

13. The assembly according to claim 1, wherein:

said successive locking teeth and first channels around the outer circumference of the muzzle device comprises successive locking teeth of a first locking teeth type and first channels around the outer circumference of the muzzle device at a first axial location of the muzzle device and successive locking teeth of a second locking teeth type and first channels around the outer circumference of the muzzle device at a second axial location of the muzzle device the locking teeth of the first locking teeth type and the locking teeth of the second locking teeth type are separated by a first groove in the axial direction of the muzzle device, the locking teeth of the first locking teeth type have a design that differs from the design of the locking teeth of the second locking teeth type, said successive locking lugs and second channels around the inner circumference of the substantially tubular muzzle adapter comprises successive locking lugs of a first locking lugs type and second channels around the inner circumference of substantially tubular muzzle adapter at a first axial location of the substantially tubular muzzle adapter and successive locking lugs of a second locking lugs type and second channels around the inner circumference of the substantially tubular muzzle adapter at a second axial location of the substantially tubular muzzle adapter, the locking lugs of the first locking lugs type and the locking lugs of the second locking lugs type are separated by a second groove in the axial direction of the substantially tubular muzzle adapter, the locking lugs of the first locking lugs type have a design that differs from the design of the locking lugs of the second locking lugs type, the locking teeth of the first locking teeth type have a design and the locking teeth of the second locking teeth type have a design that prevents one of the locking teeth of the first locking teeth type and the locking teeth of the second locking teeth type from entering the second groove and allows the other of locking teeth of the first locking teeth type and the locking teeth of the second locking teeth type to enter the second groove when the muzzle device is rotated with respect to the substantially tubular muzzle adapter about the longitudinal central axis A, and the locking lugs of the first locking lug type have a design and the locking lugs of the second locking lug type have a design that prevents one of the locking lugs of the first locking lug type and the locking lugs of the second locking lug type from entering the first groove and allows the other of the locking lugs of the first locking lug type and the locking lugs of the second locking lug type to enter the first groove (when the muzzle device is rotated with respect to the substantially tubular muzzle adapter about the longitudinal central axis A.

14. The assembly according to claim 1, wherein:

the muzzle device extends into the sound suppressing device when the muzzle device is releasable received in the substantially tubular muzzle adapter.

15. The assembly according to claim 14, wherein:

the co-operating rotation prevention device includes tines of the muzzle device and recesses in the sound suppressing device sized and shaped for complementary receipt of at least a portion of the tines of the muzzle device.

16. The assembly according to claim 1, wherein:

the second distal end of the substantially tubular muzzle adapter is received in or surrounded by the substantially tubular attachment mount, and the second proximal end of the substantially tubular muzzle adapter is received in or surrounded by the substantially tubular clutch collar.

17. The assembly according to claim 1, wherein:

the third proximal end of the substantially tubular attachment mount is received in or surrounded by the substantially tubular clutch collar.

18. The assembly according to claim 1, wherein:

the second tubular body of the substantially tubular attachment mount includes at the third proximal end of the substantially tubular attachment mount a shoulder at an outer surface of the second tubular body of the substantially tubular attachment mount and an outer surrounding guiding surface at the outer surface of the second tubular body of the substantially tubular attachment mount between the shoulder and the third proximal end of the substantially tubular attachment mount, the fourth distal end of the substantially tubular clutch collar abuts the shoulder, and an inner surrounding guiding surface at the fourth distal end of the third tubular body of the substantially tubular clutch collar circumferentially abuts the outer surrounding guiding surface at the outer surface of the second tubular body of the substantially tubular attachment mount.

19. The assembly according to claim 1, wherein at least one of the muzzle device, the substantially tubular muzzle adapter, the substantially tubular attachment mount, the substantially tubular clutch collar, and the sound suppressing device are metallic.

* * * * *